US007471921B2

(12) United States Patent
Fuwazaki et al.

(10) Patent No.: US 7,471,921 B2
(45) Date of Patent: Dec. 30, 2008

(54) DEVELOPING DEVICE AND IMAGE FORMING APPARATUS

(75) Inventors: Takeshi Fuwazaki, Nagoya (JP); Masahiro Ishii, Nagoya (JP); Isao Kishi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 350 days.

(21) Appl. No.: 11/403,842

(22) Filed: Apr. 14, 2006

(65) Prior Publication Data

US 2006/0239724 A1 Oct. 26, 2006

(30) Foreign Application Priority Data

Apr. 25, 2005 (JP) ..... 2005-126099

(51) Int. Cl.
*G03G 15/08* (2006.01)

(52) U.S. Cl. ..... 399/284

(58) Field of Classification Search ..... 399/272–274, 399/281, 283, 284
See application file for complete search history.

(56) References Cited

U.S. PATENT DOCUMENTS

| | | | | |
|---|---|---|---|---|
| 5,191,170 | A | 3/1993 | Yoshida et al. | |
| 6,980,752 | B2 | 12/2005 | Kamimura | |
| 2003/0175054 | A1* | 9/2003 | Sato | 399/284 |
| 2006/0153600 | A1* | 7/2006 | Huang | 399/284 |
| 2007/0280726 | A1* | 12/2007 | Ishii | 399/284 |
| 2008/0063439 | A1* | 3/2008 | Kondo et al. | 399/284 |

FOREIGN PATENT DOCUMENTS

| | | | |
|---|---|---|---|
| JP | H04-204971 | A | 7/1992 |
| JP | H06-295120 | A | 10/1994 |
| JP | H09-190071 | A | 7/1997 |
| JP | 2000284589 | | 10/2000 |
| JP | 2000352870 | | 12/2000 |
| JP | 2001-083797 | A | 3/2001 |
| JP | 2003195628 | | 7/2003 |

OTHER PUBLICATIONS

Japanese Patent Office, Notification of Reason for Refusal for Japanese Patent Application No. 2005-126099, dated Jul. 15, 2008. (Counterpart to above-captioned U.S. patent application). (Partial Translation).

* cited by examiner

*Primary Examiner*—Susan S Lee
(74) *Attorney, Agent, or Firm*—Baker Botts L.L.P.

(57) ABSTRACT

A developing device including: a developer carrying member that is rotatably supported and carries a developer; and a layer thickness regulating member that extends in an axial direction of the developer carrying member and is provided with a pressing part that is in pressure contact with a surface of the developer carrying member to form a thin layer of the developer on the surface of the developer carrying member. The pressing part includes a center portion and two end portions. The center portion of the pressing part is formed of a first elastic material. The end portions of the pressing part are formed of a second elastic material that is different from the first elastic material.

12 Claims, 12 Drawing Sheets

DEVELOPING DEVICE AND IMAGE FORMING APPARATUS

CROSS REFERENCE TO RELATED APPLICATION

This application claims priority from Japanese Patent Application No. 2005-126099 filed on Apr. 25, 2005, the entire subject matter of which is incorporated herein by reference.

TECHNICAL FIELD

The present invention may relate to a developing device which is mounted on a laser printer, and to an image forming apparatus provided with the developing device.

BACKGROUND

Conventionally, in an image forming apparatus such as a laser printer, a developing cartridge containing toner has been detachably mounted on an apparatus body. The developing cartridge is provided with a toner containing part that contains the toner, a supply roller for supplying the toner contained in the toner containing part, a developing roller which carries the toner supplied from the supply roller, and a layer thickness regulating blade which is brought into pressure contact with the developing roller.

When the layer thickness regulating blade is in pressure contact with the developing roller, a thin layer of the toner is formed on a surface of the developing roller. When the developing cartridge is opposed to a photosensitive drum which is mounted on the apparatus body, the toner carried in a center area of the developing roller is used for developing an electrostatic latent image which has been formed on the photosensitive drum. However, the toner carried in side end areas of the developing roller will stay there, and an amount of the toner will be increased. Consequently, the toner will likely leak from end parts of the developing roller.

In order to solve the above described problem, it has been proposed in JP-A-2003-195628, for example, that in a layer thickness regulating blade formed of a leaf spring which is provided with a pressing part of silicone rubber, both end portions corresponding to side end areas of the developing roller are cut away, and the silicone rubber in these portions is formed in a discontinuous shape having a different sectional shape from the center portion.

Specifically, in a case where the pressing part of the layer thickness regulating blade has a curved face in an area to be in contact with the developing roller, a radius of curvature in both end portions of the pressing part is made smaller than in the center portion. On the other hand, in a case where the pressing part in an area to be in contact with the developing roller has a flat face, an angle of both end portions of the pressing part with respect to a tangent of the developing roller is made larger than that of the center portion. In this manner, the pressing part is formed so that a larger amount of the toner can be scraped off in both the end portions of the pressing part.

However, because the pressing part of the above described layer thickness regulating blade is formed of silicone rubber, the silicone rubber will be worn by sliding friction with the developing roller, when printing has been repeated. Particularly, both the end portions of the pressing part are formed in such a shape that a larger amount of the toner can be scraped off the end portions than the center portion, and will be worn to a larger extent, as compared with the center portion. When both the end portions of the layer thickness regulating blade have been worn from longtime use, in this manner, the toner in the side end areas of the developing roller cannot be sufficiently scraped off, and will stay in these areas. As the results, there is a problem that leakage of the toner from the end parts of the developing roller may occur.

SUMMARY

One aspect of the present invention may provide a developing device including: a developer carrying member that is rotatably supported and carries a developer; and a layer thickness regulating member that extends in an axial direction of the developer carrying member and is provided with a pressing part that is in pressure contact with a surface of the developer carrying member to form a thin layer of the developer on the surface of the developer carrying member, wherein a center portion of the pressing part is formed of a first elastic material, and wherein both of end portions of the pressing part are formed of a second elastic material that is different from the first elastic material.

DETAILED DESCRIPTION

An illustrative aspect of the present invention will be described hereinbelow with reference to the drawings.

Figure 1:
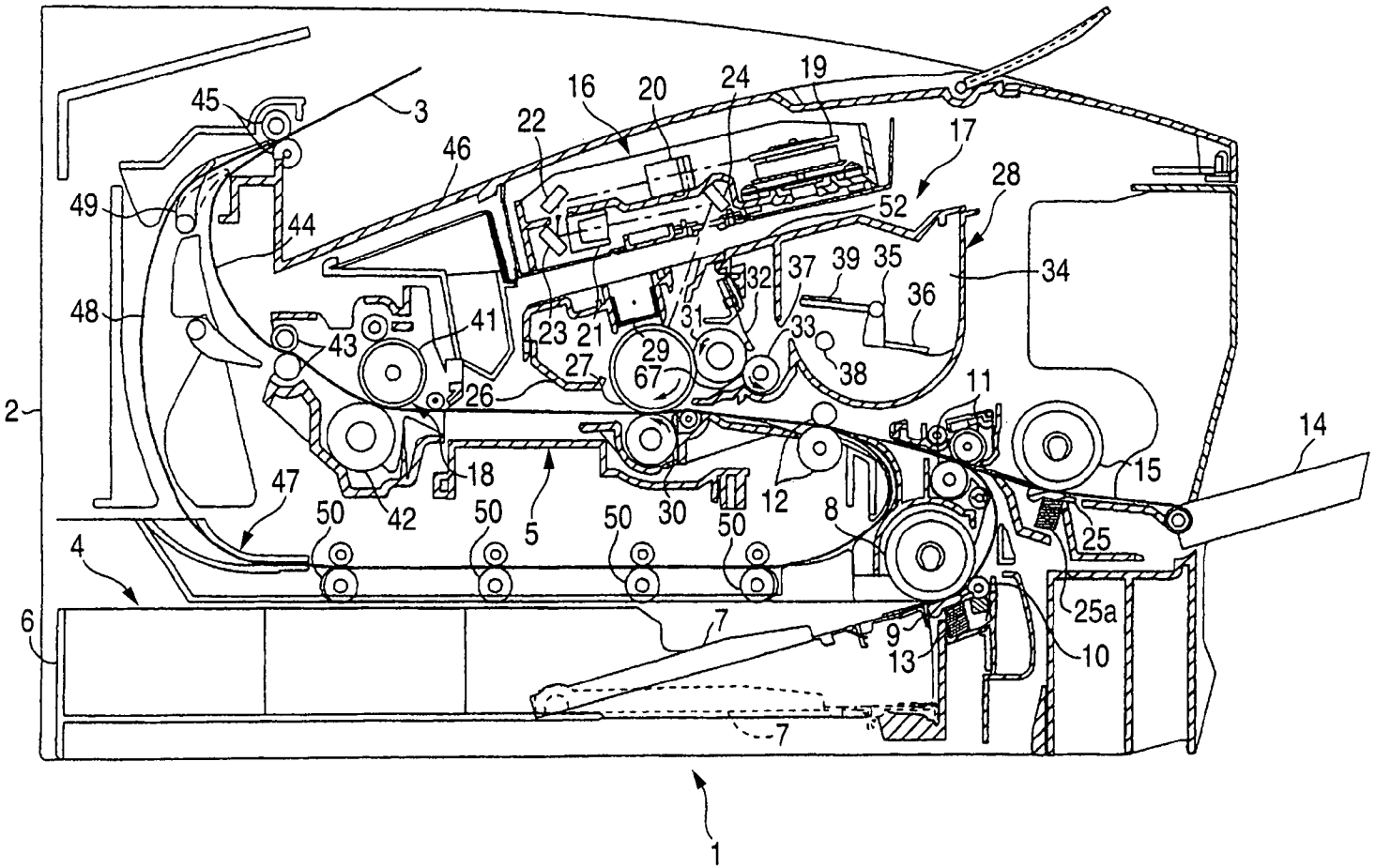
FIG. 1 is a sectional side view showing a part of a laser printer as an image forming apparatus according to an illustrative aspect.

FIG. 1 is a sectional side view showing a part of a laser printer as the image forming apparatus according to an illustrative aspect. As shown in FIG. 1, the laser printer 1 includes a main body casing 2 which contains therein a feeder section 4 for feeding sheets of paper 3 as recording medium, and an image forming section 5 for forming a determined image on the sheet of paper 3 which has been fed.

The feeder section 4 includes a paper feeding tray 6 detachably mounted on a bottom part inside the main body casing 2, a paper pressing plate 7 provided inside the paper feeding tray 6, a paper feeding roller 8 and a paper feeding pad 9 which are provided in an upper area of one side end part of the paper feeding tray 6, paper dust removing rollers 10 and 11 provided downstream from the paper feeding roller 8 in a paper conveying direction for conveying the sheet 3, and a registration roller 12 provided downstream from the paper dust removing rollers 10, 11 in the paper conveying direction for conveying the sheet 3.

The paper pressing plate 7, which is capable of stacking the sheets 3 in a stacked state, is tiltably supported at one end remote from the paper feeding roller 8, whereby the other end close to the paper feeding roller 8 can move in a vertical direction. The paper pressing plate 7 is urged from a back side in an upward direction by a spring, which is not shown. Accordingly, the paper pressing plate 7 will be downwardly tilted against an urging force of the spring around the end which is remote from the paper feeding roller 8, as an amount of the stacked sheets 3 increases. The paper feeding roller 8 and the paper feeding pad 9 are arranged so as to be opposed to each other. The paper feeding pad 9 is urged toward the paper feeding roller 8 by a spring 13 which is provided on a back side of the paper feeding pad 9. The uppermost sheet 3 on the paper pressing plate 7 will be urged toward the paper feeding roller 8 by a spring, which is not shown, from a back side of the paper pressing plate 7. Then, the uppermost sheet 3 will be caught between the paper feeding roller 8 and the paper feeding pad 9 with rotation of the paper feeding roller 8. Thereafter, the sheets 3 will be fed one by one. The sheet 3 which has been fed will be sent to the registration roller 12, after paper dust has been removed by the paper dust removing roller 10 and 11. The registration roller 12 has a pair of rollers, and is adapted to send the sheet 3 to the image forming section 5, after determined registration of the sheet 3 has been completed.

Moreover, the feeder section 4 is further provided with a multipurpose tray 14, a multipurpose side paper feeding roller 15 and a multipurpose side paper feeding pad 25 for feeding the sheets 3 to be stacked on the multipurpose tray 14. The multipurpose side paper feeding roller 15 and the multipurpose side paper feeding pad 25 are opposed to each other, and the multipurpose side paper feeding pad 25 is urged toward the multipurpose side paper feeding roller 15 by a spring 25*a* which is provided on a back side of the multipurpose side paper feeding pad 25. The sheets 3 to be stacked on the multipurpose tray 14 will be caught between the multipurpose side paper feeding roller 15 and the multipurpose side paper feeding pad 25 by rotation of the multipurpose side paper feeding roller 15, and thereafter, will be fed one by one.

The image forming section 5 includes a scanner unit 16, a process unit 17, and a fixing unit 18.

The scanner unit 16 is provided on an upper part inside the main body casing 2. The scanner unit 16 includes a laser light emitting part (not shown), a polygon mirror 19 which is driven to rotate, lenses 20 and 21, and reflective mirrors 22, 23 and 24. A laser beam based on image data which has been emitted from the laser emitting part passes through the polygon mirror 19, the lens 20, the reflective mirrors 22 and 23, the lens 21, the reflective mirror 24 in this order, or is reflected as shown by a dotted line in FIG. 1, and is irradiated by rapid scanning onto a surface of a photosensitive drum 27 of the process unit 17, which will be described below.

The process unit 17 is arranged below the scanner unit 16. The process unit 17 includes a drum cartridge 26 detachably mounted on the main body casing 2, and the photosensitive drum 27 as a photoconductive body, a developing cartridge 28 as a developing device, a scorotron type charger 29, and a transfer roller 30, which are contained in the drum cartridge 26.

Figure 3:
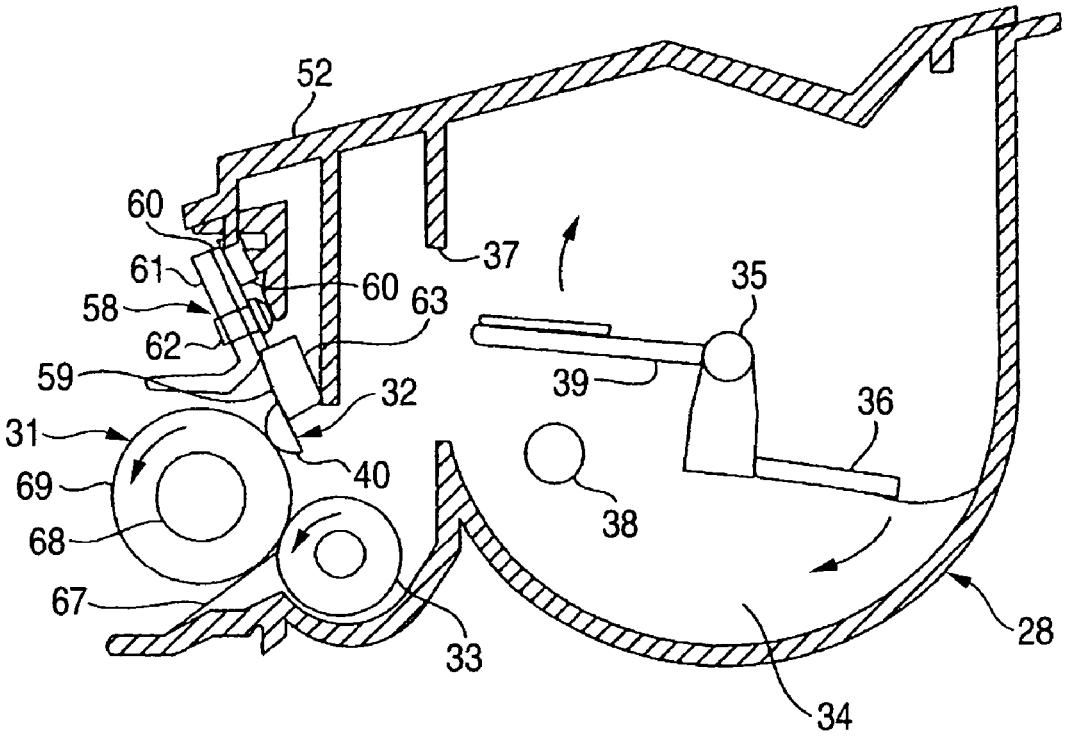
FIG. 3 is a sectional side view showing a part of a developing cartridge of the process unit as shown in FIG. 2.

The developing cartridge 28 is detachably mounted on the drum cartridge 26, as shown in FIG. 3. The developing cartridge 28 contains in a casing 52, a developing roller 31 as a developer carrying member, a layer thickness regulating blade 32 as a layer thickness regulating member, a supply roller 33, and a toner containing part 34.

The toner containing part 34 is filled with non-magnetic positively electrifying toner of mono-component type, as the developer. As this toner, polymerized toner as globular toner which is obtained by copolymerizing polymeric monomer, for example, styrene monomer such as styrene, acryl monomer such as acrylic acid, alkyl (C1-C4) acrylate, alkyl methacrylate, by known polymerization method such as suspension polymerization is employed. The polymerized toner of this type has a substantially globular shape, and can attain favorable development because of its excellent fluidity, whereby, as the result, an image of high quality can be formed. Moreover, the toner of this type is blended with coloring agent such as carbon black, wax and so on, and added with outer admixture such as silica for enhancing the fluidity. An average particle diameter thereof is about 6 to 10 μm.

The toner contained in the toner containing part 34 will be agitated by an agitator 36 supported on a rotary shaft 35 which is provided at a center of the toner containing part 34, with its rotation in a direction of an arrow mark (in a clockwise direction). The toner is discharged from a toner supply port 37 which opens in a side area of the toner containing part 34. Additionally, a window 38 for detecting a remaining amount of the toner is formed in a side wall of the toner containing part 34, and the window 38 will be cleaned by a cleaner 39 which is supported on the rotary shaft 35.

The supply roller 33 is arranged at a diagonally lower side position of the toner supply port 37 so as to rotate in a direction of an arrow mark (in a counterclockwise direction). Moreover, the developing roller 31 is opposed to the supply roller 33 so as to rotate in a direction of an arrow mark (in a counterclockwise direction), in other words, in a direction from an idle end portion (the other end portion) of a leaf spring member 59 of the layer thickness regulating blade 32, which will be described below, to a base end portion (one end portion) of the leaf spring member 59 (See FIG. 8). The supply roller 33 and the developing roller 31 are in contact with each other in a state where they are respectively compressed to some extent.

The supply roller 33 has a roller shaft made of metal, and a roller formed of electrically conductive sponge material is covered over the roller shaft.

The developing roller 31 has a roller shaft 68 made of metal. A roller 69 formed of an elastic body, which is electrically conductive rubber material, is covered over the roller shaft 68, as shown in FIG. 3 (although it will be described later). More specifically, the roller 69 of the developing roller 31 has a roller body formed of electrically conductive urethane rubber or silicone rubber containing carbon particulates or the like, and a coating layer of urethane rubber or silicone rubber containing fluorine is coated on a surface of the roller body. Moreover, a predetermined developing bias with respect to the photosensitive drum 27 is applied to the developing roller 31.

The layer thickness regulating blade 32 is arranged near the developing roller 31. The layer thickness regulating blade 32 has a fitting member 58, a leaf spring member 59 as a support member, and a pressing part 40. The fitting member 58 is arranged above the developing roller 31 so as to be opposed along an axial direction of the developing roller 31 and fitted to the casing 52 of the developing cartridge 28.

The toner discharged from the toner supply port 37 is supplied to the developing roller 31 with rotation of the supply roller 33. On this occasion, the toner is positively charged by friction between the supply roller 33 and the developing roller 31. Further, the toner supplied to a surface of the developing roller 31 intrudes between the pressing part 40 of the layer thickness regulating blade 32 and the developing roller 31, following the rotation of the developing roller 31. The toner which has intruded between the pressing part 40 and the developing roller 31 will be further charged by friction sufficiently, and carried on the developing roller 31 as a thin layer having a certain thickness, as described below.

Figure 2:
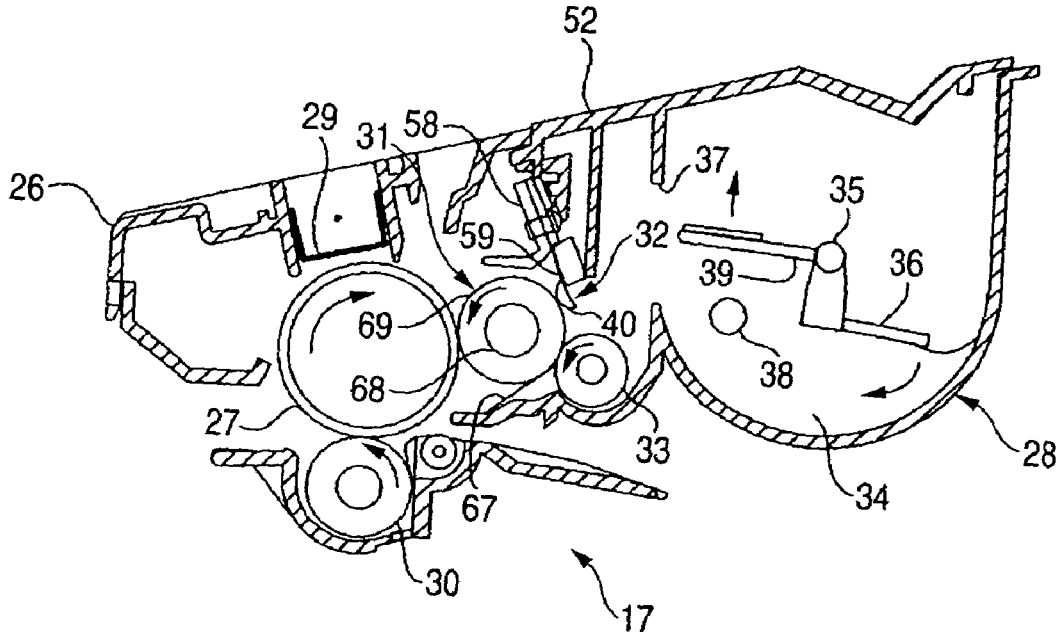
FIG. 2 is a sectional side view showing a part of a process unit of the laser printer as shown in FIG. 1.

The photosensitive drum 27 is arranged adjacent to the developing roller 31 so as to rotate in a direction of an arrow mark (in a clockwise direction) in a state opposed to the developing roller 31, as shown in FIG. 2. A drum body of this photosensitive drum 27 is earthed, and is covered by a surface part formed of a photoconductive layer composed of polycarbonate or the like to be positively charged.

The scorotron type charger 29 is arranged above the photosensitive drum 27 keeping a determined distance so as not to be in contact with the photosensitive drum 27. This scorotron type charger 29 is a charger of scorotron type for positive electrification which generates corona discharge from an electrifying wire such as tungsten, and is so constructed as to positively electrify the surface of the photosensitive drum 27 uniformly.

A surface of the photosensitive drum 27 is positively charged uniformly by the scorotron type charger 29 with the rotation of the photosensitive drum 27, and thereafter, exposed to light by rapid scanning of a laser beam from the scanner unit 16 thereby to form an electrostatic latent image based on the predetermined image data.

When the toner, carried on the developing roller 31 with the rotation of the developing roller 31 and positively charged, is brought into contact with the photosensitive drum 27, the toner will be supplied to the electrostatic latent image formed on the surface of the photosensitive drum 27. That is, the area exposed to light by the laser beam and having a lowered electric potential, out of the surface of the photosensitive drum 27 which has been positively charged uniformly, and will be selectively carried thereby to change the electrostatic latent image into a visual image. In this manner, reverse development will be achieved.

Underneath the photosensitive drum 27, the transfer roller 30 is arranged so as to be opposed to the photosensitive drum 27. The transfer roller 30 is supported by the drum cartridge 26 so as to rotate in a direction of an arrow mark (in a counterclockwise direction). The transfer roller 30 has a roller shaft made of metal and a roller formed of electrically conductive rubber material which is covered over the roller shaft. A determined transfer bias with respect to the photosensitive drum 27 is applied to the transfer roller 26, at the time of transfer. For this reason, the visual image carried on the photosensitive drum 27 will be transferred onto the sheet 3, while the sheet 3 is passing between the photosensitive drum 27 and the transfer roller 30.

The fixing unit 18 is arranged at a downstream side from and adjacent to the process unit 17, as shown in FIG. 1. The fixing unit 18 includes a heating roller 41, a pressurizing roller 42 for pressurizing the heating roller 41, and a pair of conveying rollers 43 which are provided downstream from the heating roller 41 and the pressurizing roller 42. The heating roller 41 is provided with a halogen lamp made of metal for heating. The heating roller 41 will fix, by heating, the toner, which has been transferred onto the sheet 3 in the process unit 17, while the sheet 3 passes between the heating roller 41 and the pressuring roller 42. Thereafter, the sheet 3 will be conveyed by the conveying rollers 43 toward a paper discharging path 44. The sheet 3 conveyed to the paper discharging path 44 will be conveyed to discharging rollers 45 and discharged onto a discharging tray 46 by means of the discharging rollers 45.

Moreover, the laser printer 1 in the illustrative aspect is provided with a reversing and conveying part 47 for forming images on both faces of the sheet 3. This reversing and conveying part 47 has the paper discharging roller 45, a reversing and conveying path 48, a flapper 9, and a plurality of reversing and conveying rollers 50.

The paper discharging roller 45 has a pair of rollers, and is so constructed that the roller can be switched between the normal rotation and the reverse rotation. As described above, in a case where the sheet 3 is discharged onto the discharging tray 46, the paper discharging roller 45 rotates in the normal direction, and in a case where the sheet 3 is reversed, the paper discharging roller 45 rotates in the reverse direction.

The reversing and conveying path 48 is provided along the vertical direction so that the sheet 3 can be conveyed from the paper discharging roller 45 to a plurality of the reversing and conveying rollers 50 which are provided underneath the image forming section 5. An upstream end of the reversing and conveying path 48 is arranged near the paper discharging roller 45, and a downstream end thereof is arranged near the reversing and conveying rollers 50.

The flapper 49 is tiltably provided so as to be opposed to a branching point between the paper discharging path 44 and the reversing and conveying path 48, and so constructed that the direction of conveying the sheet 3 which has been reversed by the paper discharging roller 45 can be switched from the direction toward the paper discharging path 44 to the direction toward the reversing and conveying path 48, according to on or off of a solenoid which is not shown.

A plurality of the reversing and conveying rollers 50 are provided in a substantially horizontal direction, above the paper feeding tray 6. The most upstream reversing and conveying roller 50 is arranged near a back end of the reversing and conveying path 48, and the most downstream reversing and conveying roller 50 is arranged below the registration roller 12.

In a case where images are formed on both faces of the sheet 3, the reversing and conveying part 47 will be operated as follows. When the sheet 3, which has the image formed on its one face, has been conveyed from the paper discharging path 44 to the paper discharging roller 45 by the conveying roller 43, the paper discharging roller 45 conducts the normal rotation having the sheet 3 clamped therein, and once conveys this sheet 3 outward (toward the paper discharging tray 46). When most of the sheet 3 has been conveyed outward and a backward end of the sheet 3 has been clamped by the paper discharging roller 45, the normal rotation will be stopped. Then, the paper discharging roller 45 will rotates reversely, and the flapper 49 will switch the conveying direction so as to convey the sheet 3 to the reversing and conveying path 48, whereby the sheet 3 will be conveyed to the reversing and conveying path 48 in a state where a front side and a back side are reversed. After the sheet 3 has been conveyed, the flapper 49 will be switched to the original state, that is, in a state where the sheet 3 which has been fed from the conveying roller 43 will be conveyed to the paper discharging roller 45. Then, the sheet 3 which has been conveyed to the reversing and conveying path 48 in the reverse direction will be conveyed to the reversing and conveying rollers 50, and conveyed from the reversing and conveying rollers 50 to the registration roller 12 in a state reversed upside down. The sheet 3 which has been conveyed to the registration roller 12 will be subjected again to the determined registration in the reversed state, and thereafter, conveyed to the image forming section 5. In this manner, a determined image will be formed on both the faces of the sheet 3.

Moreover, in this laser printer 1, residual toner will be recovered by a so-called cleanerless system, that is, the system in which the residual toner which remains on the surface of the photosensitive drum 27, after the image has been transferred to the sheet 3 by the transferring roller 30, is recovered by the developing roller 31. By recovering the residual toner on the surface of the photosensitive drum 27 by this cleanerless system, it is not necessary to provide a cleaner unit such as a blade and storage means for waste toner, and so, it will be possible to achieve a simple and compact structure of the apparatus, and to reduce cost.

Figure 5:
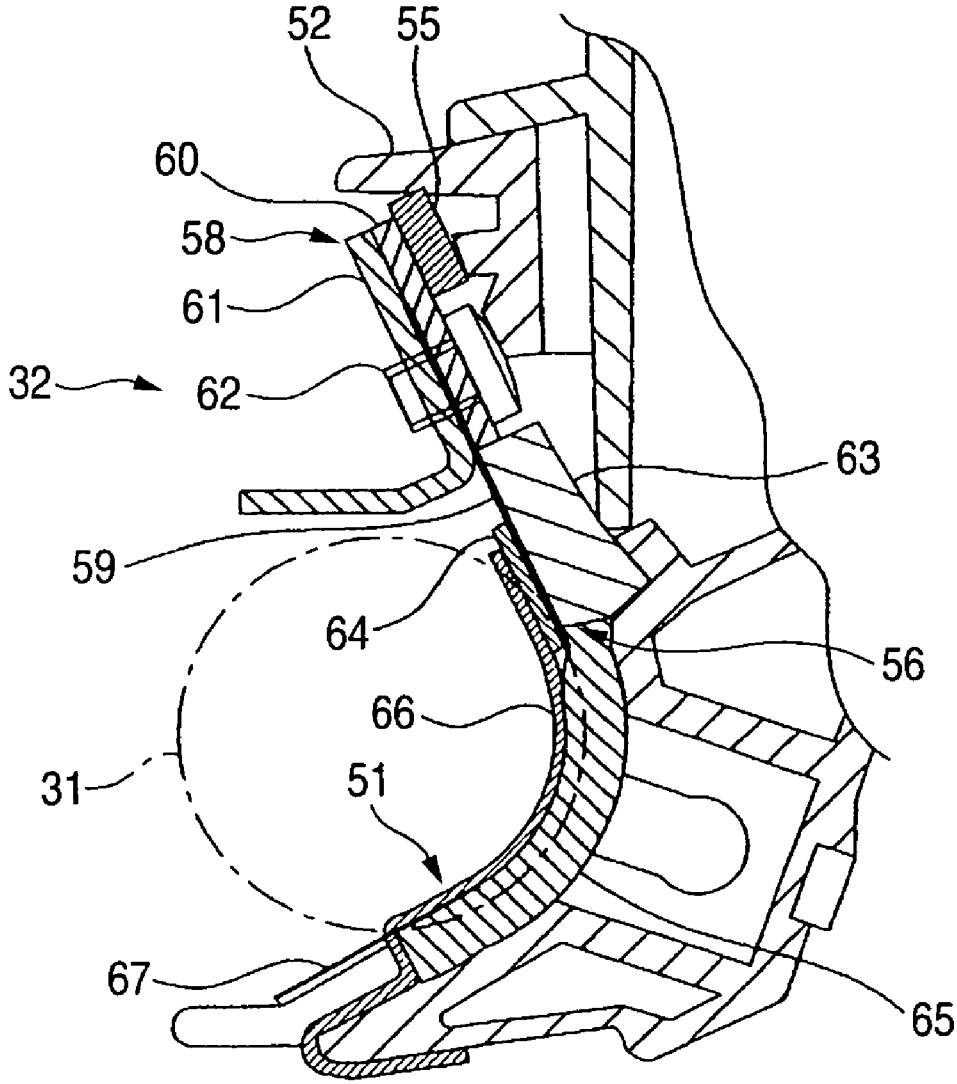
FIG. 5 is a sectional side view showing the part of the seal structure in the end part in the axial direction of the developing roller, as shown in FIGS. 4A and 4B, in a state where the developing roller is not mounted.
Figure 6:
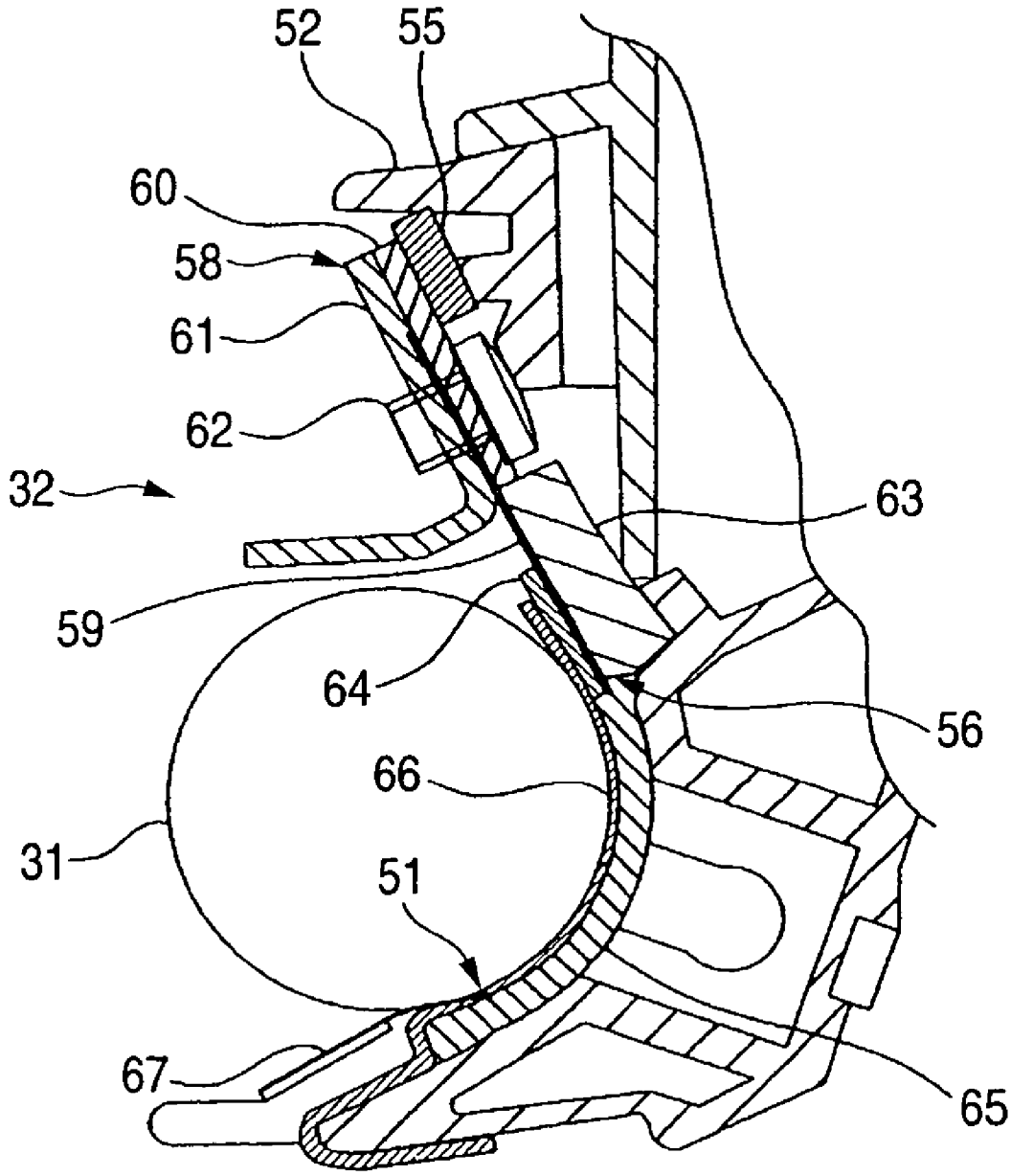
FIG. 6 is a sectional side view showing the part of the seal structure in the end part in the axial direction of the developing roller, in a state where the developing roller is mounted.

In the developing cartridge 28 of this laser printer 1, side seals 51 are respectively provided at opposite end parts in an axial direction of the developing roller 31, as sealing members for preventing the toner which is carried by the developing roller 31 from leaking to an exterior of the casing 52 from the opposite end parts in the axial direction of the developing roller 31 which is rotated at the developing time. Referring to FIGS. 4 to 6, the side seal 51 will be described below, along with a sealing structure at one end part in the axial direction of the developing roller 31. Only the one end part in the axial direction of the developing roller 31 is illustrated in FIGS. 4 to 6, and only the one end part in the axial direction will be described below. However, it is to be noted that the other end part in the axial direction of the developing roller 31 has substantially the same structure.

As shown in FIG. 4, at the end part in the axial direction of the developing roller 31 in the developing cartridge 28, the casing 52 is open at its front face, and a support hole 54 for fitting the developing roller 31 thereto is formed in a side wall 53. Adjacent to the side wall 53, there are provided, together with the side seal 51, an upper side seal 55, a blade side seal 56, as shown in FIG. 5, and a lower side seal 57 as a lower side seal member, as shown in FIG. 4. Leakage of the toner at the end in the axial direction of the developing roller 31 will be reliably prevented by means of the side seal 51, the upper side seal 55, the blade side seal 56 and the lower side seal 57. Moreover, the support hole 54 is open at its front side end, so that a roller shaft 68 of the developing roller 31 can be received along its open end 75.

As shown in FIGS. 5 and 6, the upper side seal 55 is in a shape of a substantially rectangular plate having a determined thickness, and formed of sponge material such as urethane. The upper side seal 55 is attached, by a double-faced adhesive tape or the like, to an upper part of the fitting member 58 of the layer thickness regulating blade 32 so as to be opposed thereto, above a side end part in a lateral direction of the casing 52 adjacent to the side wall 53.

The blade side seal 56 is provided in a lower part of the leaf spring member 59 of the layer thickness regulating blade 32, in a side end part in a lateral direction of the leaf spring member 59, and includes a back blade seal 63 provided on the other face (a back face) of the leaf spring member 59, and a front blade seal 64 provided on a surface (a front face) of the leaf spring member 59. The fitting member 58 of the layer thickness regulating blade 32 includes a back support member 60, and a front support member 61 having a substantially L-shape in cross section. The front support member 61 is opposed to the back support member 60, and is fixed by a screw 62 to an upper part of the casing 52 in a state where the leaf spring member 59 is clamped between the back support member 60 and the front support member 61.

The back blade seal 63 is in a shape of a substantially rectangular plate having a determined thickness, and formed of sponge material such as urethane. The back blade seal 63 is attached to the back face of the leaf spring member 59 by a double-faced adhesive tape or the like, in a state where its upper end part is in contact with a lower end part of the back support member 60.

The front blade seal 64 is in a shape of a substantially rectangular plate having a determined thickness, and formed of sponge material such as urethane. The front blade seal 64 is attached to the surface of the leaf spring member 59 opposed to the back blade seal 63, by a double-faced adhesive tape or the like.

Moreover, as shown in FIG. 4, the lower side seal 57 is in a shape of a substantially rectangular plate having a determined thickness, and formed of sponge material such as urethane. The lower side seal 57 is arranged at the end part in the lateral direction of the casing 52, inward of and adjacent to the side seal 51 which will be described below, and attached to the surface of the lower part of the casing 52 by a double-faced adhesive tape or the like. By providing the side seal 51 and the lower side seal 57 to be in contact with the lower layer 67 (See FIG. 2) as a lower seal member, it is possible to prevent leakage of the toner in a boundary part to which the side seal 51, which will be described below, and the lower layer 67 (See FIG. 2) are attached.

The side seal 51 is provided at a side end part in the lateral direction of the casing 52 adjacent to the side wall 53 so as to be slidably in contact with the outer peripheral face of the developing roller 31. This side seal 51 includes a sponge seal member 65, and a sliding contact seal member 66 which is stacked on the sponge seal member 65 and serves as a sliding contact face with respect to the developing roller 31.

The sponge seal member 65 is formed of an elastic foamed body which is sponge material such as urethane. More specifically, the sponge seal member 65 is formed of high density micro cell urethane foam (Trade name: PORON, a product of Rogers Inoac corporation) which has relatively higher rigidity than other sponges, and is unlikely to be permanently deformed. Its hardness is 0.001 to 0.05 MPa, more preferably, 0.005 to 0.025 MPa, in 25% compression load. This sponge seal member 65 is formed in a shape of a sheet having a certain thickness so that the seal member will be compressed to exert a determined pressure, when the developing roller 31 is mounted.

Figure 4A:
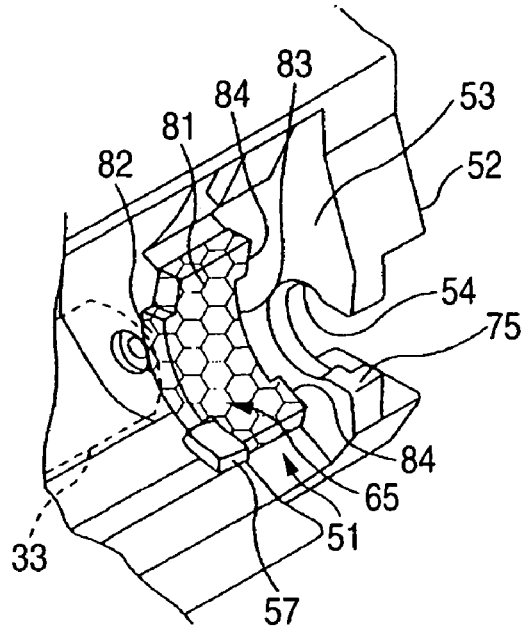
FIGS. 4A and 4B are perspective view showing a part of a seal structure in an end part in an axial direction of a developing roller and a supply roller (wherein the developing roller is not mounted), in the developing cartridge as shown in FIG. 3, in a state where a sponge seal member of a side seal is attached (FIG. 4A), but the supply roller is not mounted, and in a state where a sliding contact seal member is stacked on the sponge seal member, and the supply roller is mounted (FIG. 4B)
Figure 4B:
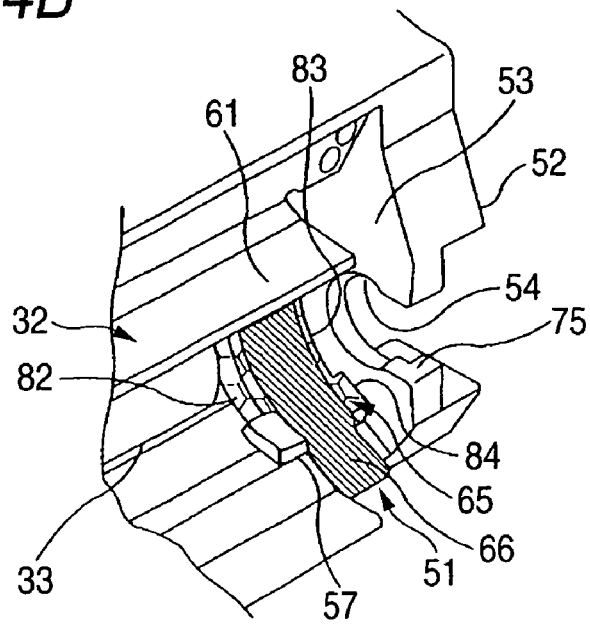

Moreover, as shown in FIGS. 4A and 4B, this sponge seal member 65 is integrally provided with a substantially rectangular base part 81 to which the sliding contact seal member 66, which will be described below, is attached, and a projected part 82 which is projected in a rectangular shape from the base part 81 inwardly in the axial direction of the developing roller 31. The base part 81 is formed with a recess 83 in a rectangular shape at a corresponding position at an opposite side to the side where the projected part 82 is formed. The sponge seal member 65 will be positioned in the lateral direction of the casing 52, when a side end part 84, which is the side end part where the recess 83, is formed has come into contact with the side wall 53 of the casing 52.

Further, this sponge seal member 65 is attached to the casing 52 by a double-faced adhesive tape or the like, in a state where its upper end part is in pressure contact with a lower end part of the back blade seal 63 of the blade side seal 56, as shown in FIG. 5, and its lower end part is overlapped on the lower side seal 57 in the lateral direction of the casing 52, as shown in FIG. 4A.

The sliding contact seal member 66 is composed as a fabric formed of cashmere fiber material, and used in a form of a substantially rectangular sheet of the fabric. As shown in FIG. 4B, this sliding contact seal member 66 is stacked on the base part 81 of the sponge seal member 65 at the lateral side end of the casing 52 adjacent to the side wall 53. As shown in FIG. 5, the upper end of the sliding contact seal member 66 covers the lower end part of the leaf spring member 59 and the front blade seal 64 up to the vicinity of its upper end. The lower end part of the sliding contact seal member 66 further extends downwardly from the lower end of the sponge seal member 65 to be attached to the casing 52 by a double-faced adhesive tape or the like, in a manner of wrapping the lower end part of the casing 52.

By attaching the upper end part of the sliding contact seal member 66 to the lower end part of the leaf spring member 59 in this manner, gaps between the sliding contact seal members 66 of the respective side seals 51 and the layer thickness regulating blade 32 can be eliminated. Hence, leakage of the toner from the side seals 51 can be further prevented.

Moreover, in a case where the front blade seal 64 is almost completely covered by the upper end part of the sliding contact seal member 66, leakage of the toner through side parts of the pressing part 40 of the layer thickness regulating blade 32 can be reliably prevented. Because the sliding contact seal member 66 moves along with movement of the leaf spring member 59 of the layer thickness regulating blade 32, the movement of the leaf spring member 59 will not be restrained, and therefore, favorable pressure contact of the developing roller 31 with the pressing part 40 can be assured. Further, because the front blade seal 64 is formed of sponge material having an adequate collapsing amount, repulsive force of the pressing force between the sliding contact seal member 66 and the developing roller 31 can be favorably absorbed, and sealing performance between the sliding contact seal member 66 and the developing roller 31 can be reliably obtained.

The upper face of the end part of the casing 52 where the side seal 51 is provided is formed in a curved shape along the outer peripheral face of the developing roller 31 so that the side seal 51 may be tightly in contact with the developing roller 31. Accordingly, the sponge seal member 65 and the sliding contact seal member 66 are stacked along this curved shape, and a surface of the sliding contact seal member 66 is formed in a curved shape along the outer peripheral face of the developing roller 31 so as to be in tight contact with the developing roller 31.

Then, by inserting the roller shaft 68 of the developing roller 31 along the support hole 54 from the front face side of the casing 52 which is open, the developing roller 31 is rotatably mounted and held in the casing 52. As a result, the outer peripheral face of the end part in the axial direction of the developing roller 31 will be brought into tight contact with the surface of the sliding contact seal member 66 so as to slide. In this manner, leakage of the toner to the exterior of the casing 52 from the end part in the axial direction of the developing roller 31 with the rotation of the developing roller at the time of developing will be sealed between the outer peripheral face of the end part in the axial direction of the developing roller 31 and the surface of the sliding contact seal member 66.

Moreover, the lower layer 67 (See FIGS. 2 and 3) formed of a PET (polyethylene terephtharate) sheet, a urethane rubber layer or the like is attached by a double-faced adhesive tape to the upper face of the lower end part of the casing 52 along its entire width. Therefore, leakage from the lower side of the casing 52 along its longitudinal direction will be reliably prevented by the lower layer 67 which is in contact with the developing roller 31 along its axial direction.

Figure 7:
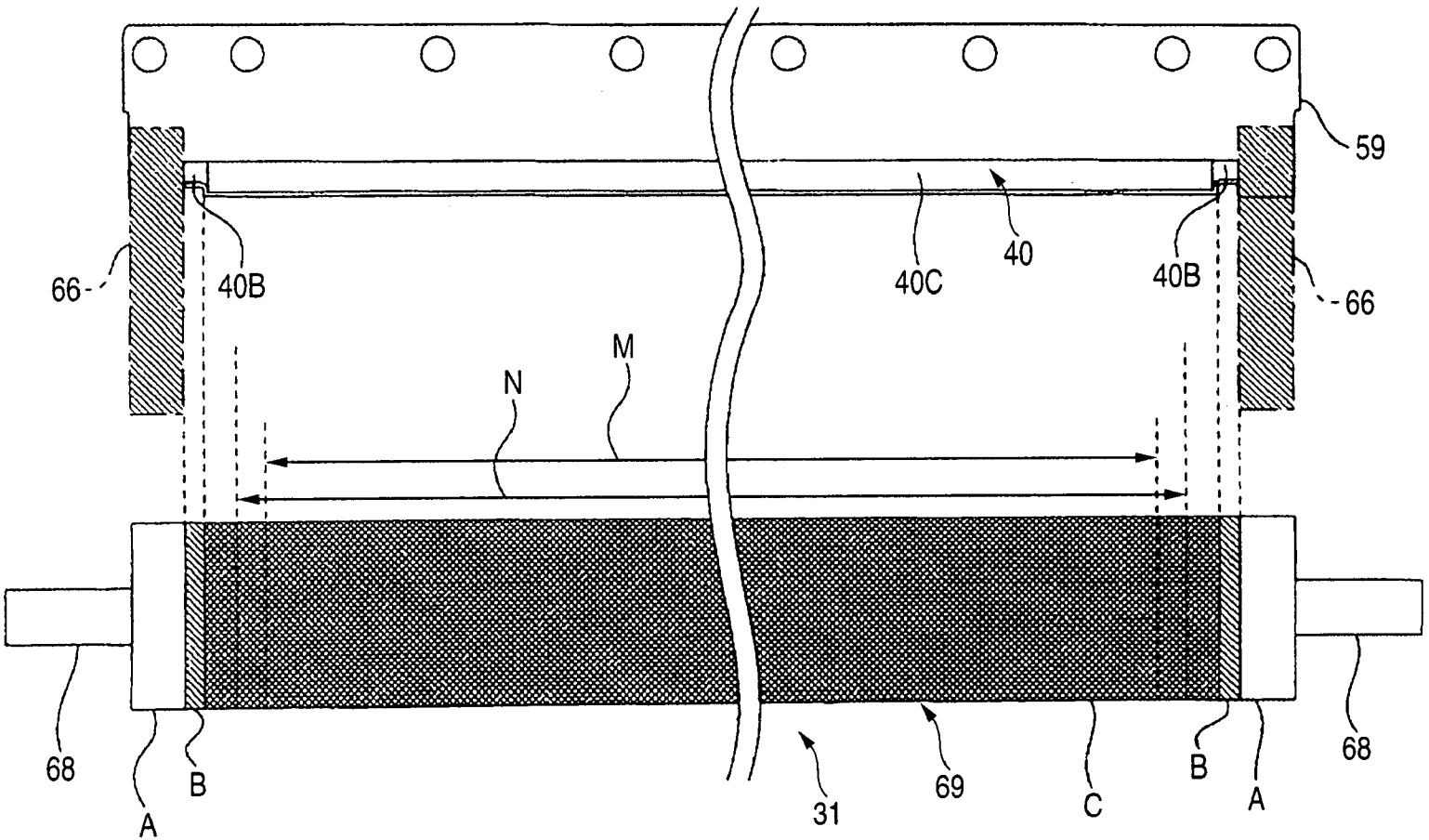
FIG. 7 is a plan view showing relation between the developing roller, and a leaf spring member and a pressing part of a layer thickness regulating blade, as shown in FIG. 3.

Now, the developing roller 31 in this developing cartridge 28 will be described in detail. As shown in FIG. 7, the roller 69 of the developing roller 31 has, on its outer peripheral face, seal areas A, side end areas B, and a center area C in the axial direction.

The seal areas A are the areas at both side end parts of the roller 69, corresponding to those parts which are in sliding contact with the sliding contact seal members 66 of the side seals 51 when the developing roller 31 has been mounted in the casing 52. The seal areas A are provided axially inwardly from respective side end edges of the roller 69, and has the same width as the width of the sliding contact seal members 66 of the side seals 51. Surface roughness of these seal areas A is smaller than surface roughness of the center area C, which will be described below, and more specifically, the surface roughness (Rz: ten point average roughness) is 2 μm or less. Hardness of the seal areas A is larger than the hardness of the center area C, which will be described below, and more specifically, the hardness (JIS A) is 50 degree or more.

The side end areas B are the areas located adjacent to the seal areas A at inward positions in the axial direction (that is, a longitudinal direction) of the developing roller 31. The side areas B are formed in an axially inward direction of the roller 69 from the respective seal areas A, having the same width as the width of side end pressure contact parts 40B, which are both end portions of the pressing part 40, which will be described below. These side end areas B are formed axially outsides of the developing roller 31 so as not to be overlapped with a first area M of the developing roller 31 corresponding to the image forming area of the photosensitive drum 27 (the area where the electrostatic latent image is formed), and further, a second area N of the developing roller 31 corresponding to the largest width of the sheet 3 which is used in the laser printer 1. Surface roughness of these side end areas B is smaller than the surface roughness of the center area C, which will be described below, and more specifically, the surface roughness (Rz: ten point average roughness) is 2 μm or less. Hardness of the side end areas B is larger than the hardness of the center area C, which will be described below, and more specifically, the hardness (JIS A) is 50 degree or more.

The center area C is the area interposed between both the side end areas B, and is formed in an axially inward direction of the roller 69 from both the side end areas B, having the same width as the width of a center pressure contact part 40C, which is a center portion of the pressing part 40 which will be described below. The surface roughness of this center area C is larger than the surface roughness of the seal areas A and the side end areas B, and more specifically, the surface roughness (Rz: +point average roughness) is 3 to 9 μm. The hardness of the center area C is smaller than the hardness of the seal areas A and the side end areas B, and more specifically, the hardness (JIS A) is 30 to 50 degree.

The developing roller 31 provided with the seal areas A, the side end areas B, and the center area C which have the different surface roughness and hardness, in this manner, can be produced in the following process. Specifically, the developing roller 31, whose surface roughness in the seal areas A and the side end areas B is different from the surface roughness in the center area C, can be produced, for example, by once polishing an entire surface of the roller 69 of the developing roller 31 before forming a coating layer thereon, then, polishing again the areas corresponding to the seal areas A and the side end areas B where the surface roughness is made smaller, and thereafter, covering the entire surface of the roller 69 with a coating layer. On the other hand, the developing roller 31, whose hardness in the seal areas A and the side end areas B is different from in the center area C, can be produced for example, by separately forming rollers corresponding to the seal areas A and the side end areas B where the hardness of the surface is larger, and a roller corresponding to the center area C where the hardness of the surface is smaller, connecting these rollers to integrally form the roller 69, polishing the entire body, and thereafter, covering it with a coating layer.

Because the side end areas B of this developing roller 31 have the smaller surface roughness than the center area C, the surfaces of the side end areas B are formed smoother than the surface of the center area C, making the toner unlikely to be carried there. Accordingly, when a toner layer is formed by the layer thickness regulating blade 32, which will be described below, an amount of the toner carried on the side end areas B can be made smaller than an amount of the toner carried on the center area C.

Moreover, because the seal areas A have also the smaller surface roughness than the center area C, the surfaces of the seal areas A are formed smoother than the surface of the center area C. Accordingly, leakage of the toner can be further prevented owing to enhanced tight contact of the seal areas A with respect to the side seals 51.

Further, because the side end areas B of this developing roller 31 have the larger hardness than the center area C, the surfaces of the side end areas B are formed harder than the surface of the center area C, making the toner unlikely to be carried thereon, when the toner layer is formed by the layer thickness regulating blade 32, which will be described below. Accordingly, the amount of the toner carried on the side end areas B after the layer thickness regulating blade 32 of the developing roller 31 has passed can be easily and reliably made smaller than the amount of the toner carried on the center area C.

Moreover, because the seal areas A have also the larger surface roughness than the center area C, the surfaces of the seal areas A are formed harder than the surface of the center area C. Accordingly, leakage of the toner can be further prevented owing to enhanced tight contact of the seal areas A with respect to the side seals 51.

As described above, the layer thickness regulating blade 32 which is arranged above the developing roller 31 so as to be opposed thereto along the axial direction of the developing roller 31 includes the fitting member 58 to be fitted to the casing 52 of the developing cartridge 28, the leaf spring member 59 as the support member, and the pressing part 40.

The fitting member 58 is provided with the back support member 60, the front support member 61, and the screw 62, and fixed to the casing 52 of the developing cartridge 28.

The leaf spring member 59 is formed of leaf spring material made of metal, and its base end portion is supported on the casing 52 by the fitting member 58, while its idle end portion is formed in a shape of a substantially rectangular plate in a front view so as to extend toward the developing roller 31 (See FIG. 7).

The pressing part 40 is formed in an elongated rectangular shape, as shown in FIG. 7, and elastically supported along the axial direction of the developing roller 31, at the idle end portion of the leaf spring member 59, as shown in FIG. 3.

The pressing part 40 is so constructed as to be in pressure contact with the surface of the developing roller 31 by the elastic force of the leaf spring member 59.

In the developing cartridge 28, the leaf spring member 59 is cut away in a concave shape, as shown in FIG. 7, in parts adjacent to those parts to which the sliding contact seal members 66 are attached, at both inward positions in the axial direction of the developing roller 31. Correspondingly, the pressing part 40 is also cut away at both end parts in its lateral direction (in the axial direction of the developing roller 31). The cut away parts at both the end parts of the pressing part 40 are the side end pressure contact parts 40B, which are respectively in pressure contact with the side end areas B of the developing roller 31. An inside in the lateral direction is the center pressure contact part 40C, which is in pressure contact with the center area C of the developing roller 31. These side end pressure contact parts 40B and the center pressure contact part 40C are formed in discontinuous and different shapes in the lateral direction.

Figure 9A:
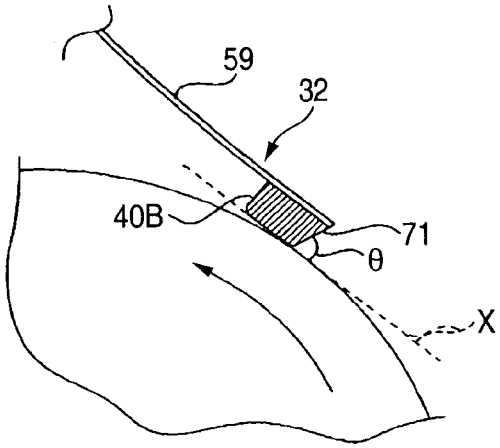
FIGS. 9A and 9B are sectional views of the pressing part as shown in FIG. 7, in another illustrative aspect, showing a contact part of a side end pressure contact part (an upstream side end part of the side end pressure contact part is formed as a flat face) with the developing roller (FIG. 9A), and a contact part of a center pressure contact part (an upstream side end part of the center pressure contact part is formed as a flat face) with the developing roller (FIG. 9B)
Figure 9B:
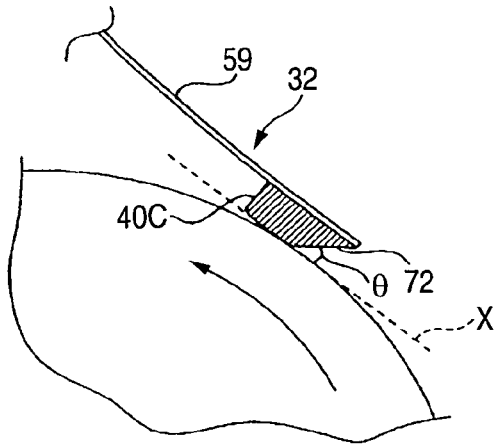

Specifically, in a case where an upstream side end part 71 of the side end pressure contact part 40B, which is an upstream side end portion in the rotation direction of the developing roller 31 from a nip portion (that is, a contact portion) between the side end pressure contact part 40B and the developing roller 31, and an upstream side end part 72 of the center pressure contact part 40C, which is an upstream side end portion in the rotation direction of the developing roller 31 from a nip portion between the center pressure contact part 40C and the developing roller 31, are formed as flat faces, as shown in FIG. 9. An angle θ of the upstream side end part 71 with respect to a tangent X of the developing roller 31 at the nip portion, as shown in FIG. 9A, is formed larger than a corresponding angle θ of the upstream side end part 72 of the center pressure contact part, as shown in FIG. 9B. For information, in order that the pressing part 40 may press the developing roller 31 to obtain a desired amount of the toner on the developing roller 31, the angle θ is preferably 90 degrees or below.

A width of the nip portion in the rotation direction of the developing roller 31 is shorter, in the side end pressure contact part 40B where the upstream side end part 71 of the side end pressure contact part having the larger angle θ is formed, than in the center pressure contact part 40C where the upstream side end part 72 of the center pressure contact part having the smaller angle θ is formed. Accordingly, the pressure contact force of the side end pressure contact part 40B to be exerted on the side end area B becomes larger than the pressure contact force of the center pressure contact part 40C to be exerted on the center area C.

In this manner, when the toner supplied by the supply roller 33 is brought into contact with the pressing part 40 of the layer thickness regulating blade 32 from the opposed direction, with the rotation of the developing roller 31, a larger amount of the toner will be scraped off in the side end areas B by the side end pressure contact parts 40B, which are in pressure contact with the larger pressure contact force, while a smaller amount of the toner will be scraped off in the center area C of the developing roller 31 by the center pressure contact part 40C which is in contact with the smaller pressure contact force. Therefore, the amount of the toner carried in the side end areas B of the developing roller 31 will be smaller than the amount of the toner carried in the center area C, in the course after the nipping position with the layer thickness regulating blade 32 up to a position opposed to the photosensitive drum 27.

Figure 10A:
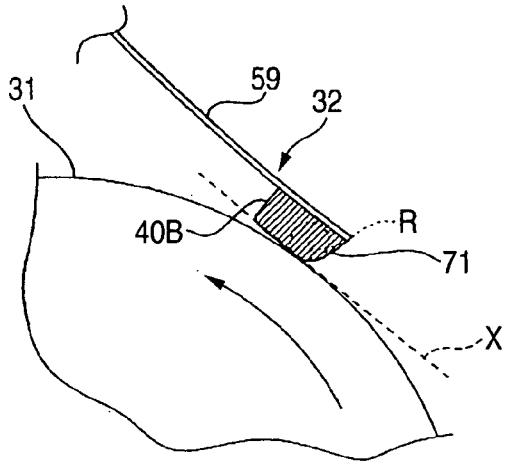
FIGS. 10A and 10B are sectional views of the pressing part as shown in FIG. 7, in still another illustrative aspect, showing a contact part of a side end pressure contact part (an upstream side end part of the side end pressure contact part is formed as a curved face) with the developing roller (FIG. 10A), and a contact part of a center pressure contact part (an upstream side end part of the center pressure contact part is formed as a curved face) with the developing roller (FIG. 10B)
Figure 10B:
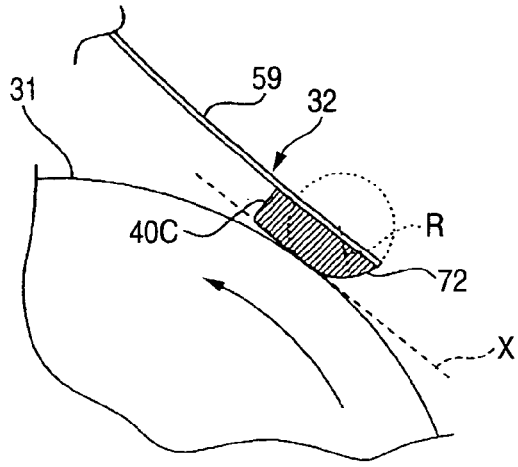

Moreover, in a case where both the side end part 71 of the side end pressure contact part and the side end part 72 of the center pressure contact part are formed as curved faces, for example, as shown in FIG. 10, the curved faces are formed in such a manner that a radius of curvature R of the side end part 71 at a position near the nip portion between the side end pressure contact part 40B and the developing roller 31, as shown in FIG. 10A, may be smaller than the corresponding radius of curvature R of the side end part 72 of the center pressure contact part, as shown in FIG. 10B.

Further, a width of the nip portion in the rotation direction of the developing roller 31 is smaller in the side end pressure contact part 40B, which is provided with the upstream side end part 71 of the side end pressure contact part having the smaller radius of curvature R than in the center pressure contact part 40C, which is provided with the upstream side end part 72 of the center pressure contact part. Therefore, the pressure contact force of the side end pressure contact part 40B to be exerted on the side end area B will be larger than the pressure contact force of the center pressure contact part 40C to be exerted on the center area C.

In this manner, when the toner supplied by the supply roller 33 is brought into contact with the pressing part 40 of the layer thickness regulating blade 32 from the opposed direction with the rotation of the developing roller 31, a larger amount of the toner will be scraped off in the side end areas B by the side end pressure contact parts 40B which are in pressure contact with the larger pressure contact force, while a smaller amount of the toner will be scraped off in the center area C of the developing roller 31 by the center pressure contact part 40C which is in pressure contact with the smaller pressure contact force. Therefore, the amount of the toner carried in the side end areas B of the developing roller 31 will be smaller than the amount of the toner carried in the center area C, in the course after the nipping position with the layer thickness regulating blade 32 up to the position opposed to the photosensitive drum 27.

Figure 8A:
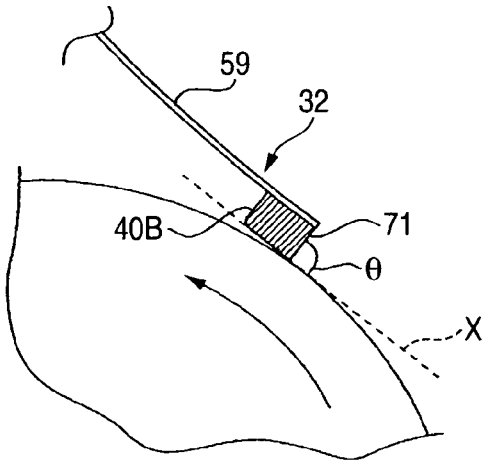
FIGS. 8A and 8B are sectional views of the pressing part as shown in FIG. 7, showing a contact part of a side end pressure contact part with the developing roller (FIG. 8A), and a contact part of a center pressure contact part with the developing roller (FIG. 8B)

In this layer thickness regulating blade 32 of the developing cartridge 28, the side end pressure contact part 40B is actually formed in a substantially rectangular shape in cross section, as shown in FIG. 8A, and the upstream side end part 71 of the side end pressure contact part is formed as a flat face. More specifically, the upstream side end part 71 is formed so that the angle θ of the upstream side end part 71 with respect to the tangent X of the developing roller 31 at the nip portion may be 90 degrees.

Figure 8B:
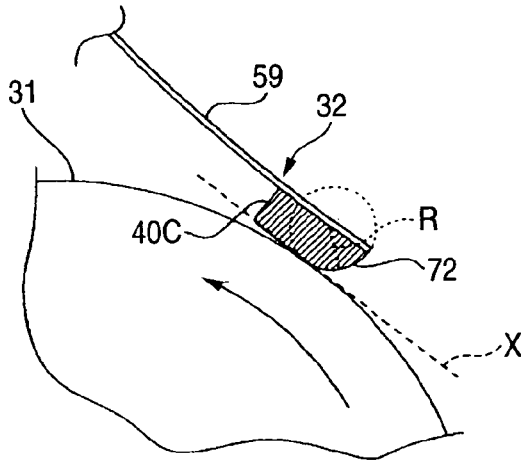

Moreover, the center pressure contact part 40C is formed in a substantially rectangular shape in cross section, as shown in FIG. 8B, and is formed so that the radius of curvature R at the position near the nip portion between the center pressure contact part 40C and the developing roller 31 may be 1.5 mm.

Further, the nip portions of the side end pressure contact part 40B and the center pressure contact part 40C with respect to the developing roller 31 are arranged on a same rectilinear line in the axial direction of the developing roller 31.

Also in such cases, in the same manner as described above referring to FIGS. 9 and 10, the width of the nip portion in the rotation direction of the developing roller 31 is smaller in the side end pressure contact part 40B, which is provided with the upstream side end part 71 of the side end pressure contact part, than in the center pressure contact part 40C, which is provided with the upstream side end part 72 of the center pressure contact part. Therefore, the pressure contact force of the side end pressure contact part 40B to be exerted on the side end area B will be larger than the pressure contact force of the center pressure contact part 40C to be exerted on the center area C.

In this manner, when the toner supplied by the supply roller 33 is brought into contact with the pressing part 40 of the layer thickness regulating blade 32 from the opposed direction with the rotation of the developing roller 31, a larger amount of the toner will be scraped off in the side end areas B by the side end pressure contact parts 40B which are in pressure contact with the larger pressure contact force, while a smaller amount of the toner will be scraped off in the center area C of the developing roller 31 by the center pressure contact part 40C which is in pressure contact with the smaller pressure contact force. Therefore, the amount of the toner carried in the side end areas B of the developing roller 31 will be smaller than the amount of the toner carried in the center area C, in the course after the nipping position with the layer thickness regulating blade 32 up to the position opposed to the photosensitive drum 27.

In other words, in any of FIGS. 8A to 10B, an entry angle of the toner supplied by the supply roller 33 entering between the developing roller 31 and the side end pressure contact part 40B (the angle when a substantial triangle is formed in a space between the upstream side end part 71 of the side end pressure contact part and the surface of the developing roller 31) is larger than an entry angle of the toner supplied by the supply roller 33 entering between the developing roller 31 and the center pressure contact part 40C (the angle when a substantial triangle is formed in a space between the upstream side end part 72 of the center pressure contact part and the surface of the developing roller 31). Accordingly, the amount of the toner introduced into the side end pressure contact part 40B will be smaller than into the center contact pressure part 40C, and the toner is less likely to enter between the side end areas B and the side end pressure contact parts 40B than between the center area C and the center pressure contact part 40C. Therefore, the amount of the toner carried in the side end areas B of the developing roller 31 will be smaller than the amount of the toner carried in the center area C, in the course after the nipping position with the layer thickness regulating blade 32 up to the position opposed to the photosensitive drum 27.

Moreover, because this layer thickness regulating blade 32 includes the pressing part 40 and the leaf spring member 59, it is possible to respectively form the side end pressure contact part 40B and the center pressure contact part 40C in desired shapes, and to set them so that the desired pressure contact forces may be applied by the leaf spring member 59. Therefore, desired designs according to the object and use, as described above, can be realized.

Because the developing roller 31 is rotated in a direction from the idle end portion of the leaf spring member 59 of the layer thickness regulating blade 32 toward the base end portion fitted to the casing 52 by the fitting member 58, the toner supplied to the developing roller 31 will be introduced into between the developing roller 31 and the pressing part 40 from the direction opposed to the leaf spring member 59 which elastically supports the pressing part 40. For this reason, the toner will be more likely to be scraped off, when the toner is in contact with the pressing part 40 with the rotation of the developing roller 31. This enables a difference, in the amount of the carried toner, between the center area C and the side end areas B, to be more distinctly and reliably created. As a result, it is possible to easily and reliably make the amount of the toner carried on the side end areas B of the developing roller 31, after the layer thickness regulating blade 32 has passed, smaller than the amount of the toner carried on the center area C.

In this developing roller 31, from the nipping position with the layer thickness regulating blade 32 to the position opposed to the photosensitive drum 27, the amount of the toner per unit area (M/A) is smaller in the side end areas B than in the center area C, due to the difference in the surface roughness and hardness between the side end area B and the center area C of the developing roller 31 and the difference in shape between the side end pressure contact part 40B and the center pressure contact part 40C of the pressing part 40 of the layer thickness regulating blade 32, as described above. In other words, a thickness of the toner layer in the side end areas B is formed thinner than a thickness of the toner layer in the center area C, and more specifically, the toner layer in the side end areas B is formed of one layer or less, as shown in FIG. 11A.

Figure 11A:
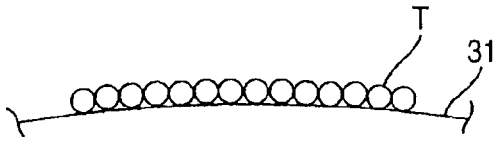
FIGS. 11A and 11B are schematic views of toner carried on the surface of the developing roller as shown in FIG. 1, in a state where the toner is carried on the surface of the developing roller in one layer (FIG. 11A), and in a state where the toner is carried on the surface of the developing roller in two or more layers (FIG. 11B).
Figure 11B:
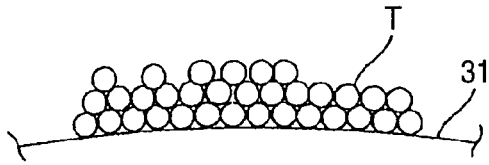

In a case where the toner layer on the surface of the side end area B is formed of two layers or more, for example, as shown in FIG. 11B, the toner T existing in the first layer from the surface of the developing roller 31 is directly in contact with the surface of the developing roller 31, and favorably carried on the surface. However, the toner T in the second and further layers is not directly in contact with the surface of the side end area B, and its interface is between the two toner layers. Accordingly, the toner will be easily removed from the surface of the side end area B, which has passed the layer thickness regulating blade 32. The toner will likely be scraped off by the side seal 51, the lower side seal 57, and the lower layer 67, when the toner returns into the developing cartridge 28 with the rotation of the developing roller 31.

However, in this developing roller 31, because the toner layer in the side end area B is formed of one layer or less, as shown in FIG. 11A, the toner T will be favorably carried on the surface of the developing roller 31. The toner will be unlikely to be scraped off by the side seal 51, the lower side seal 57, and the lower layer 67, when the toner returns into the developing cartridge 28 with the rotation of the developing roller 31. Accordingly, leakage of the toner from the developing cartridge 28 can be favorably prevented. It is noted that the state where the toner layer is formed of one layer or less includes also a state in which the toner is not carried partly on the surface of the side end area B.

The amount of the toner per unit area as described above can be obtained, as follows. Specifically, the toner carried in the course after the nipping position with the layer thickness regulating blade 32 up to the position opposed to the photosensitive drum 27 will be taken out by a suction device or the like, and a weight of the toner which has been taken out will be measured. Then, a mending tape (a product of 3M) will be attached to the surface of the roller 69 from which the toner has been removed by suction, and thereafter, the mending tape will be removed. Then, in the attached face of the mending tape, an area of a part where the toner is not provided, that is, the part from which the toner has been removed by the suction device, will be measured. Then, the amount of the toner per unit area will be calculated from the weight of the toner and the area of the part from which the toner has been removed by suction.

As described above, in this developing roller 31, in the course after the nipping position with the layer thickness regulating blade 32 up to the position opposed to the photosensitive drum 27, the amount of the toner per unit area is smaller in the side end areas B than in the center area C. In short, the thickness of the toner layer is thinner in the side end areas B than in the center area C. Therefore, during longtime use, even though the toner carried in the side end areas B comes into sliding contact with the side seals 51, the lower side seals 57, and the lower films 67, when the toner on the developing roller 31 returns into the developing cartridge 28 with the rotation of the developing roller 31, the toner carried in the side end areas B will be unlikely to be scraped off. Accordingly, leakage of the toner from the developing cartridge 28 can be favorably prevented.

In this layer thickness regulating blade 32, the upstream side end part 71 of the side end pressure contact part 40B and the upstream side end part 72 of the center pressure contact part 40C are formed in discontinuous and different sectional shapes having a step difference from each other at a boundary between them, in the lateral direction of the pressing part 40. Accordingly, a boundary between the area to be pressure in contact by the side end pressure contact part 40B and the area to be pressure in contact by the center pressure contact part 40C on the surface of the developing roller 31 will be clearly defined. As a result, the amount of the toner which is carried in the side end area B to be in pressure contact with the larger contact pressure by the side end pressure contact part 40B will be distinctly (discontinuously) defined from the amount of the toner which is carried in the center area C to be in pressure contact with the smaller contact pressure by the center pressure contact part 40C.

Specifically, in a case where the boundary between the side end pressure contact part 40B and the center pressure contact part 40C is formed in an inclined shape continuously in the lateral direction of the pressing part 40, the amount of the toner carried in the side end area B will be continuously reduced from the amount of the toner carried in the center area C. Accordingly, the boundary between the center area C carrying the larger amount of the toner and the side end area B carrying the smaller amount of the toner will be indefinite, and there is such anxiety that the toner carried in the side end area B may come into sliding contact with the side seal 51, the lower side seal 57, and the lower layer 67, and may leak from the developing cartridge 28.

However, in this developing roller 31, because the boundary between the center area C and the side end area B is distinctly defined, the boundary between the center area C having the larger amount of the toner per unit area and the thicker toner layer, and the side end area B having the smaller amount of the toner per unit area and the thinner toner layer will be definite. Accordingly, it is possible to reliably make the amount of the toner carried in the side end area B smaller and the thickness of the toner layer thinner. As the results, leakage of the toner from the developing cartridge 28 can be more effectively prevented.

First Illustrative Aspect of the Layer Thickness Regulating Blade

Further, in the layer thickness regulating blade 32, the side end pressure contact parts 40B and the center pressure contact part 40C are formed of elastic materials of respectively different substances. As described above, the pressing part 40 of the layer thickness regulating blade 32 is formed in such a shape that the contact pressure of the side end pressure contact parts 40B to be in pressure contact with the side end areas B of the developing roller 31 may be larger than the contact pressure of the center pressure contact part 40C to be in pressure contact with the center area C of the developing roller 31. Accordingly, after printing has been repeated, larger abrasion occurs in the side end pressure contact parts 40B with the sliding contact with the developing roller 31 than in the center pressure contact part 40C. In a case where the use of the apparatus is continued with such abrasion of the side end pressure contact parts 40B, the thin layer of the toner will not be properly formed in the side end areas B of the developing roller 31, and the toner will remain in this area, resulting in leakage of the toner from the end parts of the developing roller 31.

However, by forming the side end pressure contact parts 40B and the center pressure contact part 40C from the elastic materials of respectively different substances, but not from common material, it is possible to suffice performances respectively required in the side end pressure contact parts 40B and the center pressure contact part 40C, and to maintain such state for a long time.

In other words, by forming the side end pressure contact parts 40B and the center pressure contact part 40C from the elastic materials having different abrasion resistances, it is possible to form the side end pressure contact parts 40B from the elastic material having the adequate abrasion resistance required for the side end pressure contact parts 40B which are liable to be worn. Specifically, by forming the side end pressure contact parts 40B from the elastic material having the higher abrasion resistance than the center pressure contact part 40C, more specifically, from the elastic material such as urethane, it is possible to decrease wear of the side end pressure contact parts 40B caused by longtime use, and to maintain the state for a long time.

On the other hand, the center pressure contact part 40C will be less worn even after long time use, as compared with the side end pressure contact parts 40B. However, the toner must be charged by friction between the center pressure contact part 40C and the developing roller 31. By forming the side end pressure contact parts 40B and the center pressure contact part 40C from the elastic materials having different toner electrifying abilities, as abilities to charge the developer, it is possible to form the center pressure contact part 40C from the elastic material suitable for the toner electrifying ability required for the center pressure contact part 40C. Specifically, by forming the center pressure contact parts 40C from the elastic material having the higher toner electrifying ability than the side end pressure contact parts 40B (more specifically, from the elastic material such as silicone rubber), it is possible to sufficiently electrify the toner carried in the center area C of the developing roller 31. Because the center pressure contact part 40C is less worn as compared with the side end pressure contact parts 40B, the center pressure contact part 40C will be less worn, even after longtime use, than the side end pressure contact parts 40B, and it is possible to maintain the toner electrifying ability at a high level, for a long time.

As a process for forming the side end pressure contact parts 40B and the center pressure contact part 40C made of the elastic materials of different substances on the leaf spring member 59 of the single layer thickness regulating blade 32, the following processes are considered. For example, the elastic material for the side end pressure contact parts 40B and the elastic material for the center pressure contact part 40C may be respectively attached to the leaf spring member 59 by means of double-faced adhesive tapes or bonding agents.

Alternatively, an injection molding process may be employed. Specifically, the elastic material for the center pressure contact part 40C is poured into a mold, in which the leaf spring member 59 has been inserted, and is molded. Thereafter, the leaf spring member 59 is again inserted into a mold, and the material for the side end pressure contact parts 40B is poured into the mold. By employing this injection molding process, it is possible to mold the elastic materials of different substances on the leaf spring member 59 of the single layer thickness regulating blade 32.

Figure 12:
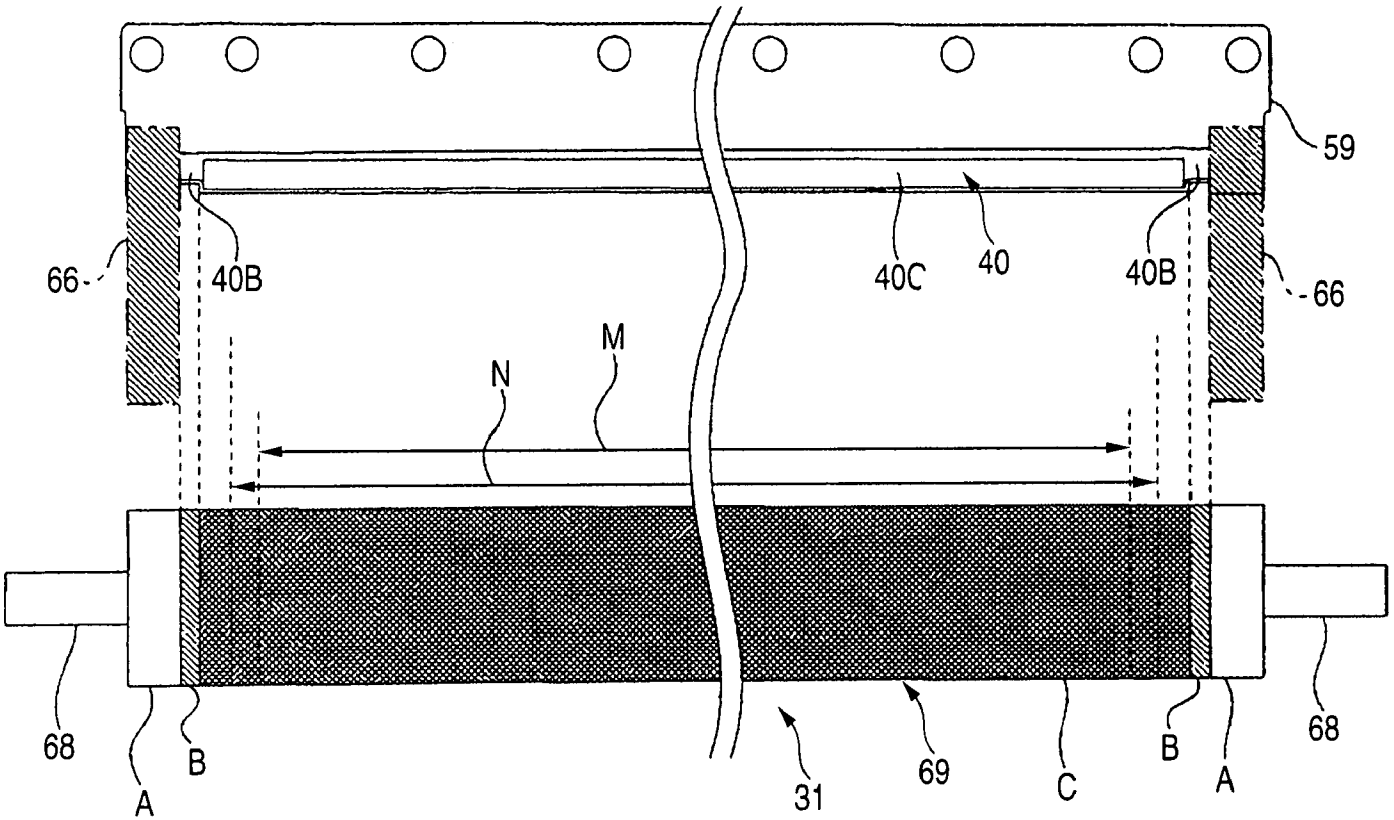
FIG. 12 is a view showing an example in which the side end pressure contact parts are connected at an upper end part of the center pressure contact part in the longitudinal direction.

Although an example in which the two side end pressure contact parts 40B are respectively formed outside the center pressure contact part 40C is illustrated in FIG. 7, the side end pressure contact parts 40B may be formed along the upper end of the center pressure contact part 40C in a continuous shape. FIG. 12 is a view showing the layer thickness regulating blade 32 which has been formed in this manner. In a case where the side end pressure contact parts 40B at both sides are continuously formed, as shown in FIG. 12, it is not necessary to conduct the injection molding twice for forming the right and left side end pressure contact parts 40B. Instead, they can be formed by only one injection molding. In this case, an area along the upper end of the center pressure contact part 40C will serve only for forming the side end pressure contact parts 40B by the one injection molding, and a very thin layer will be sufficient, provided that the area is connected to the side end pressure contact parts 40B along the upper end of the center pressure contact part 40C in the longitudinal direction.

Second Illustrative Aspect of the Layer Thickness Regulating Blade

In the above described first illustrative aspect, the example in which the center pressure contact part 40C and the side end pressure contact parts 40B in the pressing part 40 of the single layer thickness regulating blade 32 are respectively formed of the elastic materials of different substances has been described. However, the two side end pressure contact parts 40B may be formed on separate layer thickness regulating blades.

Figure 13:
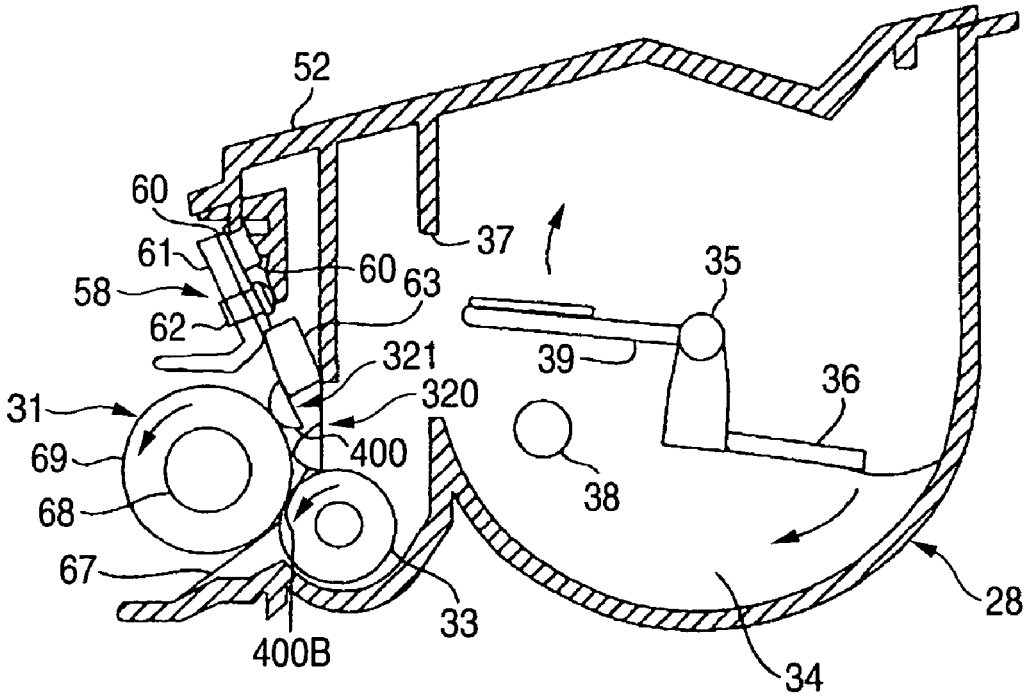
FIG. 13 is a sectional side view showing a part of a developing cartridge in which two layer thickness regulating blades are arranged along the rotation direction of the developing roller, in a second illustrative aspect.

The second illustrative aspect will be described referring to FIG. 13. FIG. 13 is a sectional side view showing an essential part of the developing cartridge 28. In this developing cartridge 28, an end part layer thickness regulating blade 320, as an end part layer thickness regulating member, is arranged at an upstream side in the rotation direction of the developing roller 31, and a center layer thickness regulating blade 321, as a center layer thickness regulating member, is arranged at a downstream side of the rotation direction of the developing roller 31. The end part layer thickness regulating blade 320 is provided with side end pressure contact parts 400B, which are in pressure contact with surfaces of at least both end portions of the developing roller 31 in the longitudinal direction to form a thin layer of the developer.

The toner carried in the side end areas B of the developing roller 31 will be scraped off by the end part layer thickness regulating blade 320 which is arranged at the upstream side in the rotation direction of the developing roller 31. Thereafter, the toner in the center area C of the developing roller 31 will be made thin-layered by a center pressure contact part 401C of the center layer thickness regulating blade 321 which is arranged at the downstream side in the rotation direction of the developing roller 31, and at the same time, the toner will be charged by friction. Moreover, the side end pressure contact parts 401B of the center layer thickness regulating blade 321 will scrape off the toner in the side end areas B of the developing roller 31.

Figure 14:
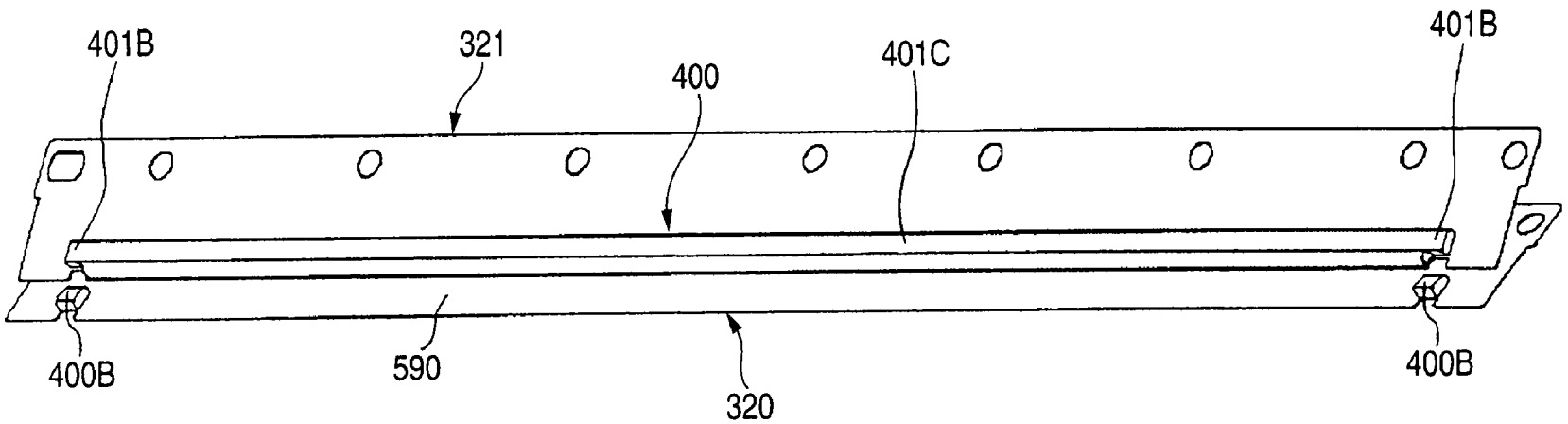
FIG. 14 is a view showing positional relation between the two layer thickness regulating blades in the second illustrative aspect, as seen from the developing roller.

FIG. 14 is a perspective view of the end part layer thickness regulating blade 320 and the center layer thickness regulating blade 321, as seen from the developing roller 31. For easy understanding, the other members including the developing roller 31 are omitted in the drawing.

The pressing part 400 of the center layer thickness regulating blade 321 is formed of elastic material of one substance, in its entirety. Specifically, the pressing part 400 is formed of silicone rubber which is suitable for electrifying the toner which is carried in the center area C of the developing roller 31. The silicone rubber will be worn by sliding contact with the developing roller 31, during the longtime use. Particularly, the side end pressure contact parts 401B are formed in such a shape that a larger amount of the toner can be scraped off, as compared with the center pressure contact part 401C, and are liable to be worn to a larger extent than the center pressure contact part 401C. In a case where the side end pressure contact parts 401B continue to be used in a state worn by abrasion, the toner carried in the side end area B of the developing roller 31 cannot be scraped off. Therefore, there is such possibility that the toner will stay there, and leakage of the toner from the end parts of the developing roller 31 may occur.

However, in the developing cartridge 28, the other layer thickness regulating blade 320 is arranged at the upstream side in the rotation direction of the developing roller 31, and the toner carried in the side end areas B of the developing roller 31 will be scraped off by the side end pressure contact parts 400B which are formed on the leaf spring member 590 of the end part layer thickness regulating blade 320. For this reason, even though the side end pressure contact parts 401B of the center layer thickness regulating blade 321 have been worn by abrasion, the toner carried in the side end areas B of the developing roller 31 will be scraped off by the side end pressure contact parts 400B of the end part layer thickness regulating blade 320 which is positioned at the upstream side in the rotation direction of the developing roller. Therefore, the problem of leakage of the toner will not happen.

Further, the side end pressure contact parts 400B are formed of elastic material having high abrasion resistance, more specifically, urethane rubber or the like, and accordingly, will be less worn, even though they have been used in sliding contact with the developing roller 31 during the long time use. Therefore, it is possible to maintain, for a long time, such a state that the toner carried in the side end areas B of the developing roller 31 can be scraped off, and occurrence of the toner leakage will be eliminated.

Although the center layer thickness regulating blade 321 includes both the side end pressure contact parts 401B and the center pressure contact part 401C, in FIG. 14, the center layer thickness regulating blade 321 may include only the center pressure contact part 401C. On the other hand, the side end layer thickness regulating blade 321 is configured so as to include at least the side end pressure contact parts 400B.

The laser printer 1 provided with the developing cartridge 28 as described in the first and second illustrative aspects is advantageous in that leakage of the toner from the end parts of the developing roller 31 can be prevented, and favorable development can be maintained for a long time.

Moreover, in the developing cartridge 28, the sliding contact faces of the sliding contact seal members 66 of the side seals 51 which are in sliding contact with the developing roller 31 are formed of fiber material. Accordingly, even though the toner in the side end areas B is in sliding contact with the side seals 51, the sliding contact seal members 66 will be favorably brought into tight contact with the seal areas A so that the leakage of the toner from the side seals 51 can be further prevented.

Further, the side end areas B are formed axially outside of the developing roller 31 so as not to be overlapped with the first area M of the developing roller 31 corresponding to the image forming area of the photosensitive drum 27, and the second area N of the developing roller 31 corresponding to the largest width of the sheet 3. Therefore, it is possible to form a favorable image with less difference in formation of the image attributed to a difference in the amounts of the toner carried in the side end areas B and the center area C, and with less anxiety of forming an incomplete image in end areas of the sheet 3.

Still further, in this developing cartridge 28, in a case where the toner layer at least carried in the parts of the side end areas B, which are adjacent to the seal areas A of the developing roller 31, is formed of one layer or less; leakage of the toner to the exterior of the casing 52 can be prevented. Therefore, the toner layer carried in the center area C may have the same thickness as the toner layer carried in the side end areas B, according to the object and use of the apparatus.

Accordingly, because the laser printer 1 has the developing cartridge 28 provided with the developing roller 31 and the layer thickness regulating blade 32 as described above, the toner will be prevented from scattering inside the main body casing 2, and so, reliable operation of the apparatus can be assured. Moreover, leakage of the toner can be reliably prevented even after longtime use, and favorable image formation can be attained.

Although the sliding contact seal member 66 is formed as a fabric of cashmere fiber material in the above described illustrative aspects, it may be formed, for example, as felt, knitted fabric, non-woven fabric, etc., and alternatively, may be formed of Teflon (Registered Trademark) or polyester fiber material.

As described with reference to the illustrative aspects, there is provided following configurations.

(1) A developing device including: a developer carrying member that is rotatably supported and carries a developer; and a layer thickness regulating member that extends in an axial direction of the developer carrying member and is provided with a pressing part that is in pressure contact with a surface of the developer carrying member to form a thin layer of the developer on the surface of the developer carrying member, wherein a center portion of the pressing part is formed of a first elastic material, and wherein both of end portions of the pressing part are formed of a second elastic material that is different from the first elastic material.

According to the configuration of (1), because the center portion and both the end portions of the pressing part of the layer thickness regulating member are formed of different elastic materials, it is possible to suffice performances as respectively required in the center portion and both the end portions of the pressing part of the layer thickness regulating member, and to maintain such situation for a long time.

(2) The developing device according to (1), wherein the first elastic material and the second elastic material are different in abrasion resistance.

According to the configuration of (2), both the end portions of the layer thickness regulating member which are likely to be worn and the center portion which is worn to less extent are formed of the elastic materials which are different in abrasion resistance. Therefore, it is possible to reduce the wear, by employing the elastic material having excellent abrasion resistance for the portions which are likely to be worn.

(3) The developing device according to (1), wherein the first elastic material and the second elastic material are different in ability to charge the developer.

According to the configuration of (3), in the pressing part of the layer thickness regulating member, the center portion where high ability to charge the developer is required and both the end portions where the high ability is not required are formed of the elastic materials which are different in the ability to charge the developer. Therefore, it is possible to enhance electrifying performance of the developer which is carried in the center area of the developer carrying member, by employing the elastic material having excellent ability to charge the developer for the center portion.

(4) The developing device according to (1), wherein the first elastic material has higher ability to charge the developer than the second elastic material, and wherein the second elastic material has higher abrasion resistance than the first elastic material.

According to the configuration of (4), it is possible to decrease the wear of both the end portions which are likely to be worn by sliding friction with the developer carrying member, by employing the elastic material having the high abrasion resistance, and at the same time, it is possible to enhance the electrifying performance of the developer in the center area where the developer must be sufficiently charged by friction, by employing the elastic material having excellent ability to charge the developer.

(5) The developing device according to (1), wherein the first elastic material is a silicone rubber, and wherein the second elastic material is an urethane rubber.

According to such the configuration of (5), it is possible to decrease the wear of both the end portions of the pressing part which are likely to be worn, by forming both the end portions of urethane rubber, and at the same time, it is possible to enhance the electrifying performance of the developer in the center portion of the pressing part where the developer must be sufficiently charged by friction, by forming the center portion from silicone rubber.

(6) The developing device according to (1), wherein the center portion of the pressing part and both of the end portions of the pressing part are formed on a single layer thickness regulating member.

According to the configuration of (6), because the center portion and both the end portions of the pressing part are formed on the single layer thickness regulating member, the wear of both the end portions of the pressing part can be decreased without adding a new member, and it is possible to prevent the developer from leaking from the end parts of the developer carrying member.

(7) A developing device including: a developer carrying member that is rotatably supported and carries a developer; a center layer thickness regulating member that extends in an axial direction of the developer carrying member and is provided with a center pressure contact part that is in pressure contact with a surface of the developer carrying member in at least a center area of the developer carrying member in a longitudinal direction to form a thin layer of the developer; and an end part layer thickness regulating member that is provided with side end pressure contact parts that are in pressure contact with a surface of the developer carrying member in at least side end areas of the developer carrying member in the longitudinal direction to form the thin layer of the developer, wherein the center pressure contact part is formed of a first elastic material, and wherein the side end pressure contact parts are formed of a second elastic material that is different from the first elastic material.

According to the configuration of (7), the developing device is provided with the center layer thickness regulating member for forming a thin layer in the center area of the developer carrying member, and the end part layer thickness regulating member for forming a thin layer in the side end areas of the developer carrying member, and the side end pressure contact parts of the end part layer thickness regulating member are formed of the elastic material of different substance from the center pressure contact part of the center layer thickness regulating member. Therefore, it is possible to suffice performances as respectively required in the side end pressure contact parts and the center pressure contact part, and to maintain such situation for a long time.

(8) The developing device according to (7), wherein the second elastic material has higher abrasion resistance than the first elastic material.

According to the configuration of (8), it is possible to reduce the wear, by employing the elastic material having excellent abrasion resistance for the side end pressure contact parts which are likely to be worn.

(9) The developing device according to (7), wherein the second elastic material is an urethane rubber.

According to the configuration of (9), it is possible to reduce the wear of the side end pressure contact parts of the pressing part which are likely to be worn, by forming them of urethane rubber.

(10) The developing device according to (7), wherein the end part layer thickness regulating member is positioned upstream from the center layer thickness regulating member in a rotation direction of the developer carrying member.

According to the configuration of (10), the center layer thickness regulating member comes into pressure contact with the surface of the developing roller, after the side end pressure contact parts of the end part layer thickness regulating member have been in pressure contact with the side end areas of the developer carrying member at the upstream side in the rotation direction, and already scraped off the toner. Therefore, even though the side end pressure contact parts in the pressing part of the center layer thickness regulating member has been worn out, the toner has been already scraped off at the upstream side, and hence, leakage of the toner can be prevented.

(11) An image forming apparatus including: a feeder section that feeds a recording medium; and an image forming section that forms an image on the recording medium that is fed by the feeder section, and is provided with a developing device, wherein the developing device includes: a developer carrying member that is rotatably supported and carries a developer; and a layer thickness regulating member that extends in an axial direction of the developer carrying member and is provided with a pressing part that is in pressure contact with a surface of the developer carrying member to form a thin layer of the developer on the surface of the developer carrying member, wherein a center portion of the pressing part is formed of a first elastic material, and wherein both of end portions of the pressing part are formed of a second elastic material that is different from the first elastic material.

(12) An image forming apparatus including: a feeder section that feeds a recording medium; and an image forming section that forms an image on the recording medium that is fed by the feeder section, and is provided with a developing device, wherein the developing device includes: a developer carrying member that is rotatably supported and carries a developer; a center layer thickness regulating member that extends in an axial direction of the developer carrying member and is provided with a center pressure contact part that is in pressure contact with a surface of the developer carrying member in at least a center area of the developer carrying member in a longitudinal direction to form a thin layer of the developer; and an end part layer thickness regulating member that is provided with side end pressure contact parts that are in pressure contact with a surface of the developer carrying member in at least side end areas of the developer carrying member in the longitudinal direction to form the thin layer of the developer, wherein the center pressure contact part is formed of a first elastic material, and wherein the side end pressure contact parts are formed of a second elastic material that is different from the first elastic material.

According to the configuration of (11) and (12), there is provided an image forming apparatus in which the leakage of the toner (developer) from the end parts of the developer carrying member is prevented, even in a case where the side end pressure contact parts of the end part layer thickness regulating member is scraped due to the printing.

According to the configurations of (1)-(5), it is possible to maintain the performances as respectively required in both the end portions and the center portion of the layer thickness regulating member, over a longtime use. Specifically, it is possible to decrease the wear of both the end portions of the layer thickness regulating member, by forming them from the elastic material having the high abrasion resistance, whereby leakage of the developer from the end parts of the developer carrying member can be prevented, and at the same time, it is possible to enhance the electrifying performance of the developer in the center portion of the layer thickness regulating member, by employing the elastic material having excellent ability to charge the developer.

According to the configuration of (6), both the end portions and the center portion in the pressing part of the single layer thickness regulating member are formed of the different elastic materials, it is possible to reliably prevent the leakage of the developer from the end parts of the developer carrying member, by simply exchanging the material of both the end portions of the pressing part, which is the member already provided, with the material having the excellent abrasion resistance.

According to the configurations of (7)-(10), in addition to the center layer thickness regulating member, there is provided the end part layer thickness regulating member having the side end pressure contact parts which are in pressure contact with the surface of the developer carrying member in at least side end areas thereof. By forming the pressing part of the end part layer thickness regulating member from the elastic material having higher abrasion resistance, it is possible to reliably prevent the leakage of the developer from the end parts of the developer carrying member, because the end part layer thickness regulating member scrapes off the developer in the side end areas of the developer carrying member at the upstream side, even though both the end portions of the center layer thickness regulating member have been worn from the longtime use.

According to the configurations of (11) and (12), it is possible to obtain the image forming apparatus in which the leakage of the developer from the end parts of the developer carrying member is unlikely to occur.

According to the present invention, there is provided a developing device in which a pressing part of a layer thickness regulating member can be prevented from being worn in both end portions thereof, even after longtime use, whereby leakage of developer from end parts of a developer carrying member can be reliably prevented, and an image forming apparatus provided with such developing device.

The foregoing description of the illustrative aspect has been presented for purposes of illustration and description. It is not intended to be exhaustive or to limit the invention to the precise form disclosed, and modifications and variations are possible in light of the above teachings or may be acquired from practice of the invention. The illustrative aspect was chosen and described in order to explain the principles of the invention and its practical application program to enable one skilled in the art to utilize the invention in various illustrative aspects and with various modifications as are suited to the particular use contemplated. It is intended that the scope of the invention be defined by the claims appended hereto, and their equivalents.

What is claimed is:

1. A developing device comprising:

a developer carrying member that is rotatably supported and carries a developer; and a layer thickness regulating member that extends in an axial direction of the developer carrying member and is provided with a pressing part that is in pressure contact with a surface of the developer carrying member to form a thin layer of the developer on the surface of the developer carrying member, the pressing part including a center portion and two end portions, wherein the center portion of the pressing part is formed of a first elastic material, and wherein the end portions of the pressing part are formed of a second elastic material that is different from the first elastic material.

2. The developing device according to claim 1, wherein the first elastic material and the second elastic material are different in abrasion resistance.

3. The developing device according to claim 1, wherein the first elastic material and the second elastic material are different in ability to charge the developer.

4. The developing device according to claim 1, wherein the first elastic material has higher ability to charge the developer than the second elastic material, and wherein the second elastic material has higher abrasion resistance than the first elastic material.

5. The developing device according to claim 1, wherein the first elastic material is a silicone rubber, and wherein the second elastic material is an urethane rubber.

6. The developing device according to claim 1, wherein the center portion of the pressing part and both of the end portions of the pressing part are formed on a single layer thickness regulating member.

7. A developing device comprising:

a developer carrying member that is rotatably supported and carries a developer;

a center layer thickness regulating member that extends in an axial direction of the developer carrying member and is provided with a center pressure contact part that is in pressure contact with a surface of the developer carrying member in at least a center area of the developer carrying member in a longitudinal direction to form a thin layer of the developer; and an end part layer thickness regulating member that is provided with side end pressure contact parts that are in pressure contact with a surface of the developer carrying member in at least side end areas of the developer carrying member in the longitudinal direction to form the thin layer of the developer, wherein the center pressure contact part is formed of a first elastic material, and wherein the side end pressure contact parts are formed of a second elastic material that is different from the first elastic material.

8. The developing device according to claim 7, wherein the second elastic material has higher abrasion resistance than the first elastic material.

9. The developing device according to claim 7, wherein the second elastic material is an urethane rubber.

10. The developing device according to claim 7, wherein the end part layer thickness regulating member is positioned upstream from the center layer thickness regulating member in a rotation direction of the developer carrying member.

11. An image forming apparatus comprising:

a feeder section that feeds a recording medium; and an image forming section that forms an image on the recording medium that is fed by the feeder section, and is provided with a developing device, wherein the developing device comprises:

a developer carrying member that is rotatably supported and carries a developer; and a layer thickness regulating member that extends in an axial direction of the developer carrying member and is provided with a pressing part that is in pressure contact with a surface of the developer carrying member to form a thin layer of the developer on the surface of the developer carrying member, the pressing part including a center portion and two end portions, wherein the center portion of the pressing part is formed of a first elastic material, and wherein the end portions of the pressing part are formed of a second elastic material that is different from the first elastic material.

12. An image forming apparatus comprising:

a feeder section that feeds a recording medium; and an image forming section that forms an image on the recording medium that is fed by the feeder section, and is provided with a developing device, wherein the developing device comprises:

a developer carrying member that is rotatably supported and carries a developer;

a center layer thickness regulating member that extends in an axial direction of the developer carrying member and is provided with a center pressure contact part that is in pressure contact with a surface of the developer carrying member in at least a center area of the developer carrying member in a longitudinal direction to form a thin layer of the developer; and an end part layer thickness regulating member that is provided with side end pressure contact parts that are in pressure contact with a surface of the developer carrying member in at least side end areas of the developer carrying member in the longitudinal direction to form the thin layer of the developer, wherein the center pressure contact part is formed of a first elastic material, and wherein the side end pressure contact parts are formed of a second elastic material that is different from the first elastic material.

* * * * *